US007601020B2

(12) United States Patent
Yoshida et al.

(10) Patent No.: US 7,601,020 B2
(45) Date of Patent: Oct. 13, 2009

(54) CONNECTOR UNIT

(75) Inventors: Haruki Yoshida, Shizuoka (JP); Sumito Atsumi, Shizuoka (JP); Eiji Fukuda, Shizuoka (JP); Hiroshi Kobayashi, Aichi (JP); Kiyoka Matsubayashi, Aichi (JP); Fumitoshi Akaike, Aichi (JP)

(73) Assignees: Yazaki Corporation, Tokyo (JP); Toyota Jidosha Kabushiki Kaisha, Toyota-shi (JP); Toyota Boshoku Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 11/893,865

(22) Filed: Aug. 17, 2007

(65) Prior Publication Data

US 2008/0057774 A1 Mar. 6, 2008

(30) Foreign Application Priority Data

Aug. 23, 2006 (JP) ..... 2006-226582

(51) Int. Cl.
*H01R 13/64* (2006.01)

(52) U.S. Cl. ..... 439/374; 439/378

(58) Field of Classification Search ..... 439/374, 439/378

See application file for complete search history.

(56) References Cited

U.S. PATENT DOCUMENTS 6,350,143 B2 * 2/2002 Kato et al. ..... 439/374

FOREIGN PATENT DOCUMENTS

| | | |
|---|---|---|
| JP | 4-104948 | 9/1992 |
| JP | 4-128654 | 11/1992 |
| JP | 05-245017 | 9/1993 |
| JP | 2000-40556 | 2/2000 |
| JP | 2003-299549 | 10/2003 |
| JP | 2005-212653 | 8/2005 |

* cited by examiner

*Primary Examiner*—Tho D Ta
(74) *Attorney, Agent, or Firm*—Kratz, Quintos & Hanson, LLP

(57) ABSTRACT

A connector unit 1 includes a seat side unit 40, a headrest side unit 41, and a guiding mechanism 60. The seat side unit 40 includes a first connector 4. The headrest side unit 41 includes a second connector 43. The guiding mechanism 60 includes a guiding rib 62 and a guiding groove 63. The guiding rib 62 is projected from an outer wall of the first connector 4. The guiding groove 63 is concaved from an inner wall of the second connector 43. When the connectors 4, 43 are connected to each other, the guiding rib 62 is inserted into the guiding groove 63 to position the connectors 4, 43 around respective axes of the connectors 4, 43.

6 Claims, 21 Drawing Sheets

CONNECTOR UNIT

CROSS REFERENCE TO RELATED APPLICATIONS

This application is on the basis of Japanese Patent Application No. 2006-226582, the contents of which are hereby incorporated by reference.

BACKGROUND OF THE INVENTION

1. Field of the Invention

The present invention relates to a connector unit having a connector used for connecting an electric wire or the like.

2. Description of the related art

Various electronic components such as a monitor or a whiplash injury prevention system may be mounted on a headrest of a vehicle. Conventionally, various connector units (for example, see Patent Document 1) are used for supplying electric power and signals to the electronic components mounted on the headrest.

A connector unit as described in Patent Document 1 includes: a first connector mounted on such as a seat, and a second connector mounted on a headrest to be connected to the first connector. The first connector is formed in a square pillar shape, and tapered walls are formed on a whole circumference of a tip of the first connector near the second connector. The second connector is formed in a square pillar shape, and tapered walls are formed on a whole circumference of a tip of the second connector near the first connector to make an inversely tapered opening.

In the connector unit described in the Patent Document 1, by contacting the tapered walls each other, the first and second connectors are positioned in two directions perpendicular to each other and perpendicular to a connecting direction to make a connection between the first and second connectors easy.

Patent Document 1: Japanese Published Patent Application No. 2000-40556

In the unit described above, because the connectors are positioned in two directions perpendicular to the connecting direction, if one connector is displaced in a rotational direction around the connecting direction, it is difficult to connect the connectors.

Accordingly, an object of the present invention is to provide a connector unit to make a connection between connectors easy even when the connectors are displaced in a rotational direction around a connecting direction.

SUMMARY OF THE INVENTION

In order to attain the object, according to the present invention, there is provided a connector unit including:

a first connector;

a second connector;

a guiding rib projected from an outer wall of the first connector and extended in a connecting direction of the first and second connectors; and a guiding groove concaved from an inner wall of the second connector and extended in the connecting direction, wherein when the connectors are connected to each other, the guiding rib is inserted into the guiding groove so as to position the connectors around respective axes thereof.

Preferably, the first connector is attached to a seat, and the second connector is attached to a headrest.

Preferably, the connector unit further includes a tapered part formed on a tip of the guiding rib near the second connector, and the tapered part causes the guiding rib to be gradually thinner as approaching the second connector.

Preferably, the connector unit further includes a widening tip part formed on a tip of the guiding groove near the first connector, and the widening tip part causes the guiding groove to be gradually wider as approaching the first connector.

These and other objects, features, and advantages of the present invention will become more apparent upon reading of the following detailed description along with the accompanied drawings.

BRIEF DESCRIPTION OF THE DRAWINGS

FIG. 11 is a front view showing a receiving member of the seat side unit shown in FIG. 1, a first connector, and the like;

DETAILED DESCRIPTION OF THE PREFERRED EMBODIMENTS

A connector unit according to an embodiment of the present invention will be explained with reference to FIGS. 1 to 26. A connector unit 1 shown in FIG. 1 is used for supplying electric power and signals to various electronic components such as a monitor or a whiplash injury prevention system mounted on a headrest of a vehicle.

Figure 1:
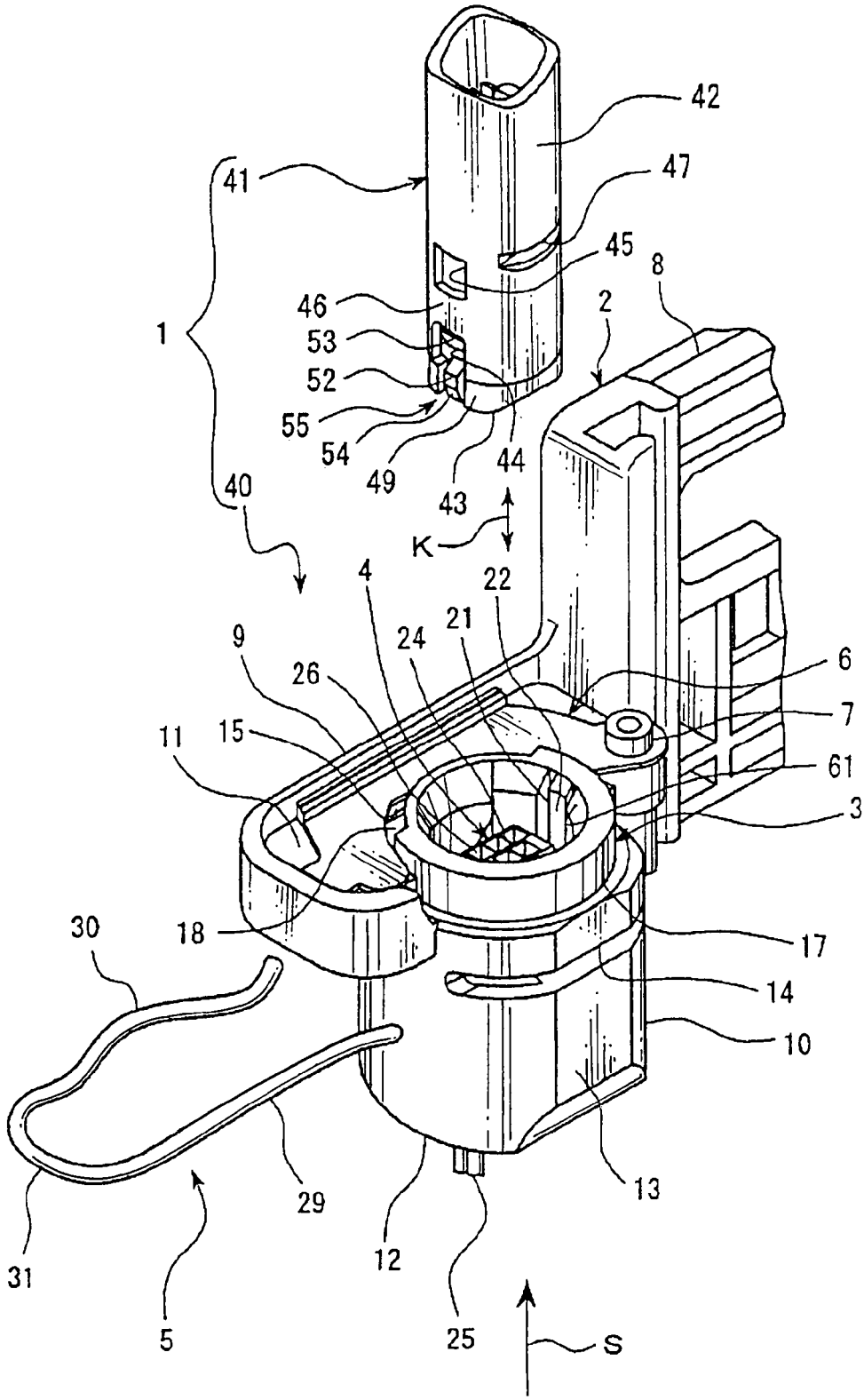
FIG. 1 is a perspective view showing a connector unit according to an embodiment of the present invention.
Figure 2:
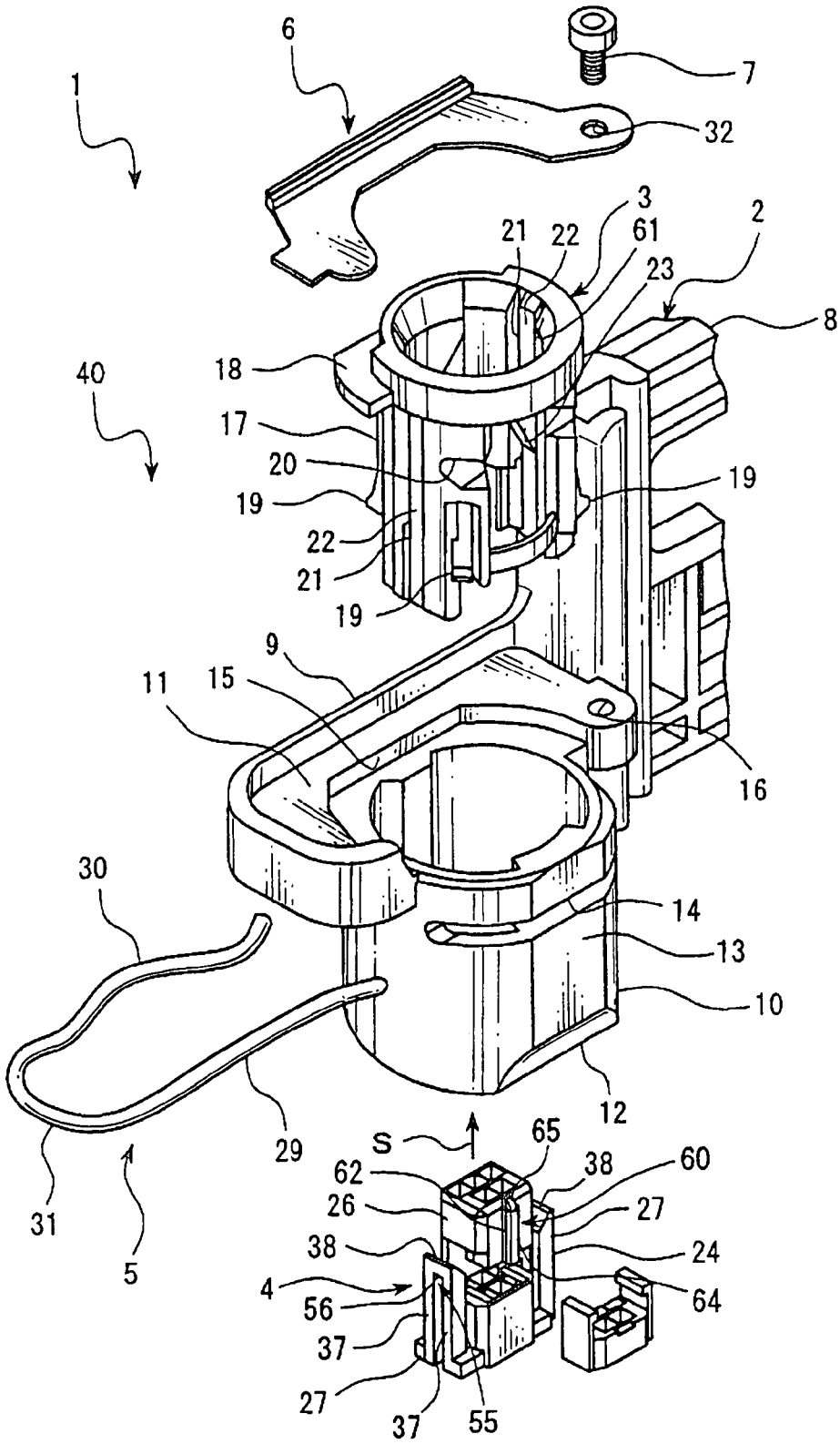
FIG. 2 is an exploded perspective view showing a seat side unit of the connector unit shown in FIG. 1.

As shown in FIGS. 1 and 2, the connector unit 1 includes: a seat side unit 40; a headrest side unit 41; a clip 5; and a guiding mechanism 60 (only shown in FIG. 2).

As shown in FIGS. 1 and 2, the seat side unit 40 includes: a bracket 2; a holder 3; a first connector 4; a plate 6 (shown in FIG. 2); and a bolt 7 (shown in FIG. 2).

Figure 11:
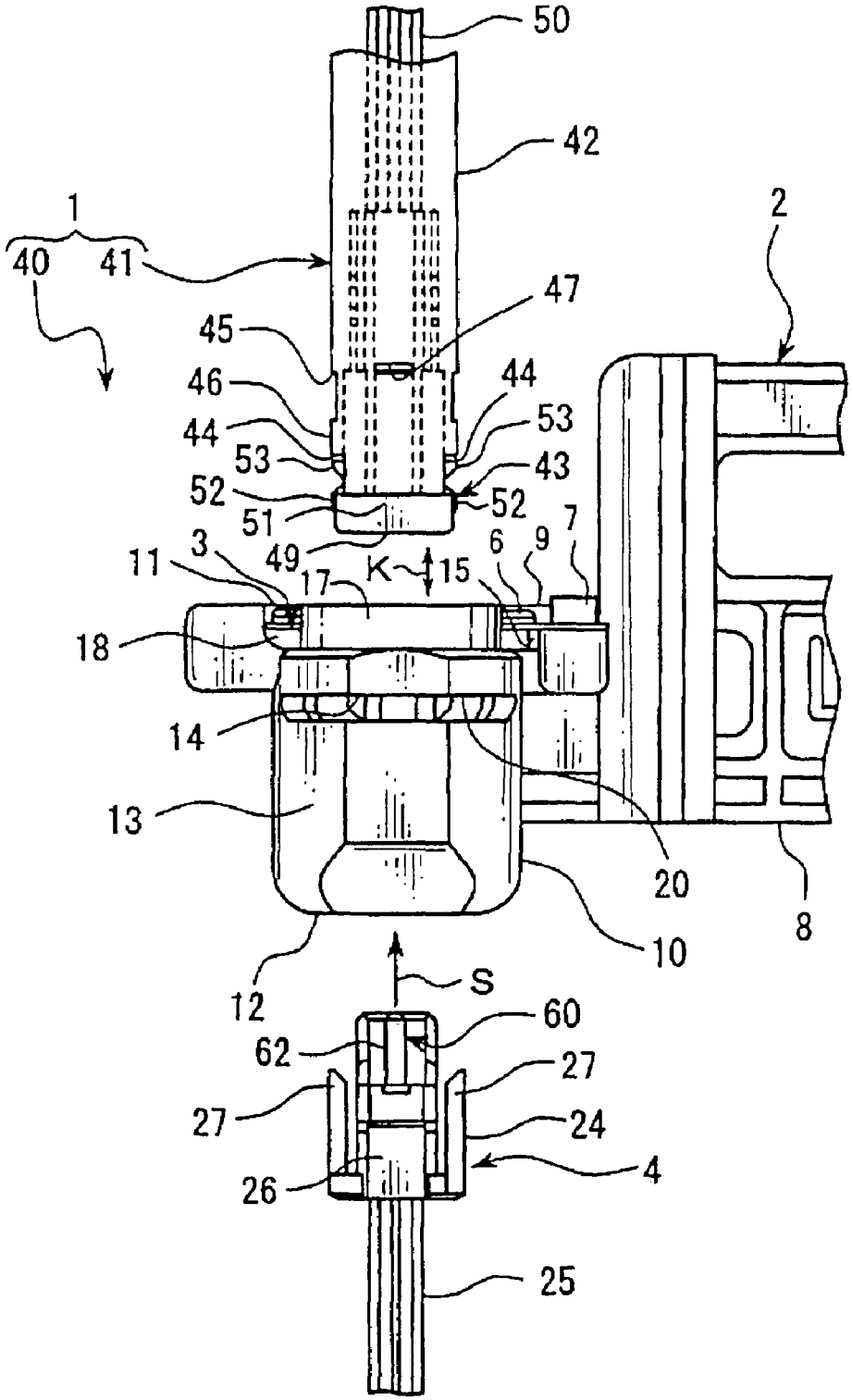
Figure 12:
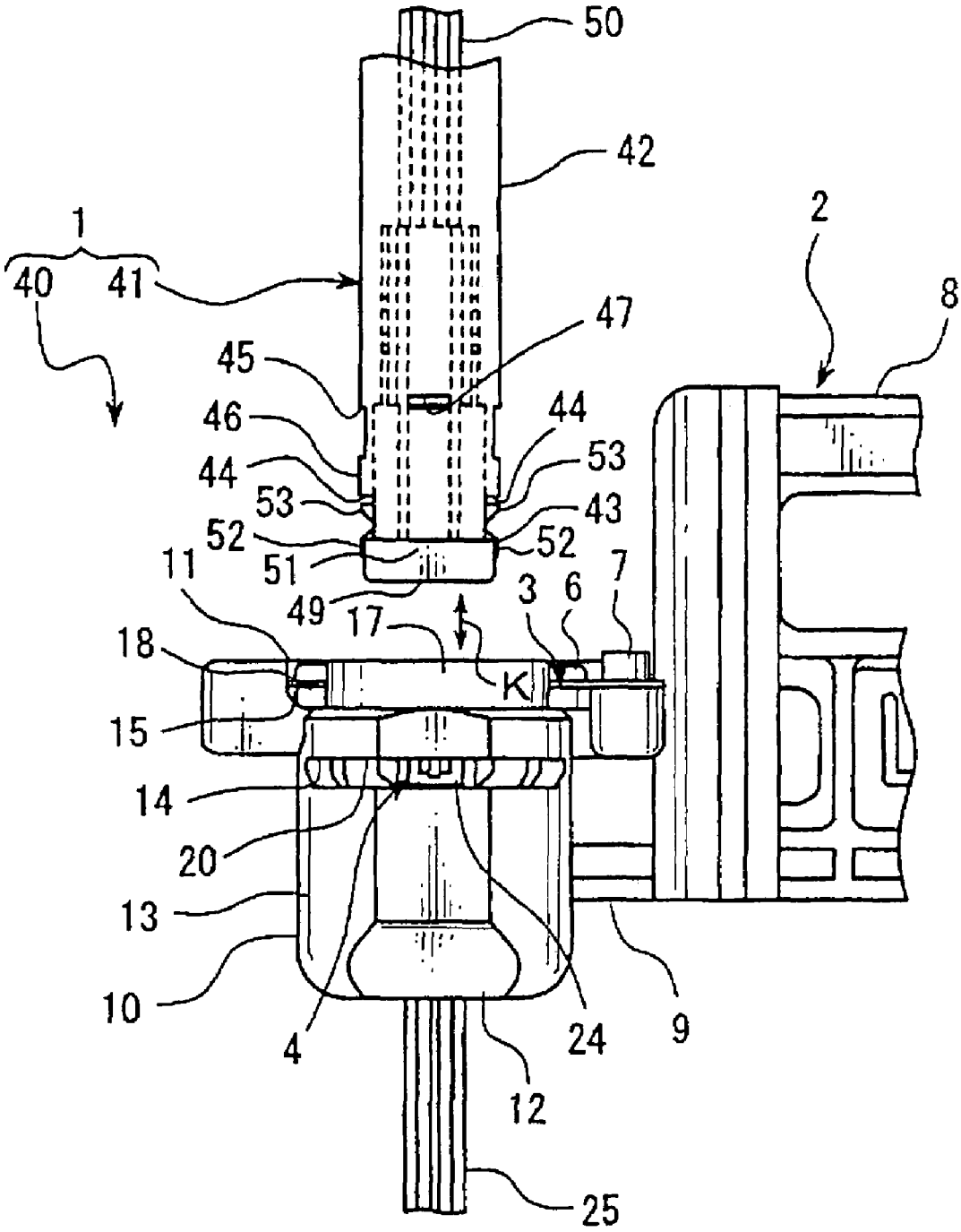
FIG. 12 is a front view showing the first connector shown in FIG. 11 held in the receiving member.

The bracket 2 is made of insulating synthetic resin, and mounted on a seat. The bracket 2 includes: a plate-shaped main body 8; and a pair of receiving members 9. The main body 8 connects the pair of receiving members 9. The pair of receiving members 9 is arranged in parallel to each other with a gap. The receiving member 9 includes: a receiving member main body 10; and a flange 11. As shown in FIGS. 11 and 12, the receiving member main body 10 integrally includes a disk shaped bottom wall 12 and a cylinder 13 vertically extended from an outer edge of the bottom wall 12.

A slit 14 penetrates the cylinder 13. The slit 14 is extended straight perpendicular to an axis of the receiving member main body 10. The slit 14 communicates with a later-described straight notch 20 formed on the holder 3 and a later-described straight slit 47 formed on a stay 42. The receiving member main body 10 receives the holder 3 to hold the holder 3.

The flange 11 is formed in a plate shape, and extended from an outer edge of the cylinder 13 of the receiving member main body 10 away from the bottom wall 12 in a radius direction of the cylinder 13 of the receiving member main body 10. The flange 11 is formed on about a half round of the outer edge of the cylinder 13 away from the bottom wall 12. A step 15 for gradually thickening the flange 11 toward an outer circumference of the flange 11 is formed on the flange 11. Further, at an end of the flange 11 near the main body 8, a bolt insertion hole 16 is formed, and a nut of which tapped hole communicates with the bolt insertion hole 16 is embedded.

The holder 3 is made of insulating synthetic resin, and formed in a cylindrical shape as a whole. As shown in FIG. 2, the holder 3 integrally includes a cylindrical holder main body 17 and a flange 18. A plurality of notches and holes are formed on the holder main body 17, and the holder main body 17 is formed in a cylindrical shape as a whole. The holder main body 17 is received in the receiving member main body 10. Therefore, the holder 3 is attached to the seat via the receiving member main body 10, namely, the bracket 2.

As shown in FIG. 2, a plurality of resiliently deformable arms 19, the straight notch 20, and holder locking arms 21 are formed on the holder main body 17. The resiliently deformable arm 19 is formed in a resiliently deformable bar shape, and one end of the resiliently deformable arm 19 is extended to the holder main body 17. The resiliently deformable arm 19 is resiliently deformable in a direction that the other end thereof is attached to and detached from the holder main body 17. When the holder main body 17 is received in the receiving member main body 10, the other end of the resiliently deformable arm 19 contacts an inner wall of the cylinder 13 of the receiving member main body 10. By the other end of the resiliently deformable arms 19 contacting the inner wall of the cylinder 13 of the receiving member main body 10, the resiliently deformable arm 19 movably supports the holder main body 17 in the receiving member main body 10, and constantly urges the holder main body 17 toward the center of the receiving member main body 10.

Further, when the other end of the resiliently deformable arm 19 abuts on a rib projecting from the inner wall of the cylinder 13 of the receiving member main body 10, the holder 3 becomes rotatable around an axis thereof relative to the receiving member main body 10, and a rotational direction of the holder 3 around the axis relative to the receiving member main body 10 is set to a predetermined direction. Incidentally, in FIG. 2, a gap is formed between the other end of the resiliently deformable arm 19 and the rib, so that without resilient deformation of the resiliently deformable arms 19, the holder 3 becomes rotatable relative to the receiving member main body 10 in an angle (range) corresponding to the gap.

The straight notch 20 is a through hole of the holder main body 17, and extended in a direction perpendicular to the axis of the holder main body 17 of the holder 3. When the holder main body 17 of the holder 3 is received in the receiving member main body 10 of the receiving member 9, the straight notch 20 is overlapped with the slit 14 and communicates with the slit 14.

In FIG. 2, a pair of holder locking arms 21 is provided. The holder locking arms 21 are disposed facing each other while the center of the holder main body 17 is disposed between the holder locking arms 21. As shown in FIG. 2, each holder locking arm 21 includes a bar-shaped arm main body 22 and a locking projection 23. A long side of the arm main body 22 is arranged along the axis of the holder main body 17. Both ends of the arm main body 22 is integrally formed with the holder main body 17, and the other parts of the arm main body 22 is separated with the holder main body 17. Namely, the arm main body 22 is supported at both ends thereof. A locking projection 23 is disposed in the center of the long side of the arm main body 22. The arm main body 22 is projected toward the other arm main body 22.

A tapered wall 61 is formed around a whole circumference of an inner wall of the holder main body 17 at an edge thereof near the headrest side unit 41. The tapered wall 61 is so inclined as to gradually widen an inner diameter of the holder main body 17 as the tapered wall 61 approaches the headrest side unit 41. When the connectors 4, 43 are connected to each other, by contacting the second connector 43, the tapered wall 61 positions the connectors 4, 43 in two directions perpendicular to each other, and perpendicular to a connecting direction K.

The flange 18 is formed in a plate shape, and extended in a radial direction from one end near the flange 11 when the holder main body 17 is received in the receiving member main body 10. The flange 18 is formed on about a half round of the one end of the holder main body 17.

The flange 18 of the holder 3 is overlapped with the flange 11 of the receiving member 9 when the holder main body 17 is received in the receiving member main body 10 of the receiving member 9. When the connector 4 is received in the holder main body 17, and a later-described locking arm 27 of the first connector 4 is engaged with the holder locking arm 21, the holder 3 holds the first connector 4. At this time, the flange 18 of the holder 3 is disposed inside of the step 15 of the receiving member 9.

As shown in FIGS. 2 to 6, the first connector 4 includes terminal fittings 36 (shown in FIG. 13) and a connector housing 24. The terminal fittings 36 are made of conductive plate metal. Ends of electric wires 25 are attached to the terminal fittings 36 so that the terminal fittings 36 are electrically connected to core wires of the electric wires 25.

The connector housing 24 is made of insulating synthetic resin, and includes a box-shaped housing main body 26 and a locking arm 27 as a first engaging member. A plurality of terminal receiving chambers is formed in the housing main body 26. Each terminal receiving chamber is extended straight. The terminal receiving chambers are arranged in parallel to each other. The terminal receiving chamber is a hole (room) of which both ends are open on outer surfaces of the housing main body 26.

Two locking arms 27 are formed on the connector housing 24. The housing main body 26 is interposed between the locking arms 27. Each locking arm 27 includes a pair of arm members 37 and a locking beak 38 connecting the arm members 37.

Each arm member 37 is formed in a bar shape extending straight, and arranged in parallel to each other with a gap. An end of the arm member 37 is extended to one end of the housing main body 26 away from the headrest side unit 41. The arm member 37 is extended from the one end thereof toward the headrest side unit 41. The arm members 37 are arranged parallel to the terminal receiving chambers. The locking beak 38 connects the other ends of the pair of arm member 37 to each other.

The locking projection 23 is interposed between the pair of arm member 37 and the locking beak 38, and the holder locking arms 21 are engaged with the other ends of the locking arms 27. Thus, the one ends of the locking arms 27 away from a later-described second connector 43 to be connected to the first connector 4 is extended to the housing main body 26. The locking arms 27 are allowed to be engaged with the holder locking arms 21. By engaging with the holder locking arms 21, the locking arms 27 hold the first connector 4 in the holder 3.

The first connector 4 is inserted into the holder main body 17 of the holder 3 from an end of the holder main body 17 away from the flange 11 to be received in the holder main body 17. When the locking projections 23 are engaged with the other end of the locking arms 27, the first connector 4 is held in the holder main body 17 of the holder 3. Incidentally, the first connector 4 is inserted into the holder main body 17 along an arrow S parallel to the axis of the holder main body 17 and the longitudinal direction of the terminal receiving chambers.

The plate 6 is made of thick metal plate and formed in a plate shape. A locking part for locking the flange 11 is formed on an end of the plate 6, and a bolt insertion hole 32 for the bolt 7 is formed on the other end of the plate 6. While the locking part is locked with the flange 11, the plate 6 is overlapped with the flange 11. Then, the bolt insertion hole 32 of the plate 6 communicates with the bolt insertion hole 16 formed on the flange 11 of the receiving member 9.

The plate 6 catches the flange 18 of the holder 3 with the flange 11 of the receiving member 9. Then, when the bolt 7 is screwed with the nut via the bolt insertion holes 32, 16, the plate 6 is attached to the flange 11 of the receiving member 9. The plate 6 fixes the holder 3 to the receiving member 9 by catching the flange 18 of the holder 3 with the flange 11 of the receiving member 9.

The seat side unit 40 having a structure described above is assembled as described below. First, the holder main body 17 is inserted into the receiving member main body 10, and the main body 8 is overlapped with the flange 11 to hold the holder 3 in the receiving member 9.

Then, the plate 6 is overlapped with the flange 18 of the holder 3, and fixed to the flange 11 of the receiving member 9 with the bolt 7. Then, as shown in FIG. 11, the connector 4 is opposed to an opening formed on the bottom wall 12. Then, the first connector 4 is inserted into the holder main body 17 of the holder 3, and held in the holder main body 17 as shown in FIG. 12. Thus, the seat side unit 40 is assembled.

Figure 6:
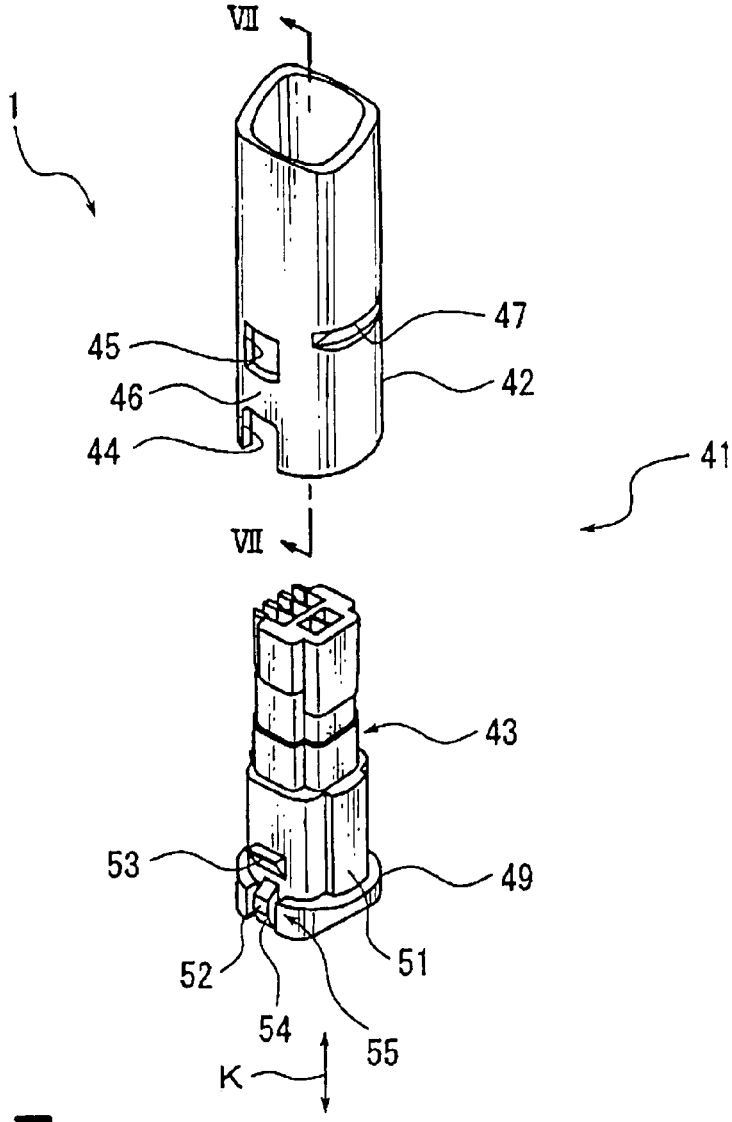
FIG. 6 is an exploded perspective view showing a headrest side unit of the connector unit shown in FIG. 1.
Figure 7:
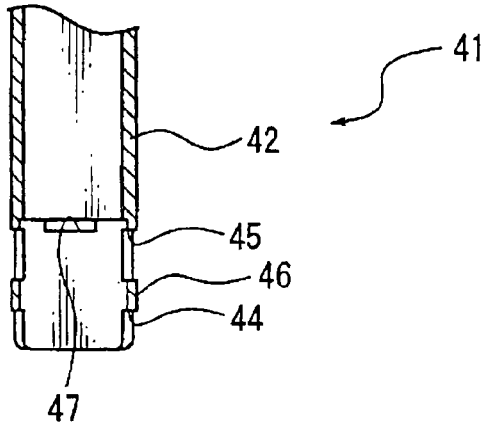
FIG. 7 is a sectional view taken on line VII-VII in FIG. 6.

As shown in FIG. 6, the headrest side unit 41 includes a stay 42 as a second holder, and the second connector 43. The stay 42 is attached to the headrest. The stay 42 is made of metal, and formed in a cylinder shape as a whole. As shown in FIGS. 6 and 7, a pair of notches 44, a pair of insertion holes 45, a pressed part 46, and a slit 47 are formed on a tip of the stay 42.

The pair of notches 44 is opposed to each other, and the axis of the stay 42 is interposed between the notches 44. The insertion holes 45 and the notches 44 are arranged along the axis of the stay 42, and a gap is formed between the insertion hole 45 and the notch 44. The insertion holes 45 is a through hole formed on the stay 42. A locking projection 23 of the holder locking arms 21 is inserted into the insertion hole 45 when the connectors 4, 43 are fully connected to each other, and the stay 42 is pushed to the bottom wall 12. Thus, the insertion hole 45 allows the locking projection 23 of the holder locking arm 21 to be inserted into the insertion hole 45 after the connectors 4, 43 are connected to each other, moved relative to the holder 3, and the locking projection 23 is released from an engagement with the first connector 4.

The pressed part 46 is interposed between the notch 44 and the insertion hole 45 arranged along the axis of the stay 42. The pressed part 46 is a part of an outer wall of the stay 42. When the connectors 4, 43 are moved relative to the holder 3 after connected to each other, the locking projection 23 of the holder locking arms 21, which is released from the engagement with the first connector 4, abuts on the pressed part 46, and presses the pressed part 46 with a resilient force of the arm main body 22 of the holder locking arms 21.

The slit 47 is extended straight perpendicular to the axis of the stay 42. The slit 47 is a through hole formed on the stay 42. When the connectors 4, 43 are connected to each other, and the stay 42 is pushed toward the bottom wall 12 of the holder 3, the slit 47 communicates with the slit 14 and the straight notch 20.

As shown in FIGS. 8 to 10 and 13, the second connector 43 includes terminal fittings 48 and a connector housing 49. The terminal fittings 48 are made of conductive plate metal. The terminal fittings 48 are attached to ends of electric wires 50 so that the terminal fittings 48 are electrically connected to core wires of the electric wires 50.

A connector housing 49 is made of insulating synthetic resin, and includes a tubular housing main body 51, a locking projection 52 as a second engaging member, and a pressing projection 53. A plurality of terminal receiving chambers is formed in the housing main body 51. Each terminal receiving chamber is extended straight. The terminal receiving chambers are arranged in parallel to each other. The terminal receiving chamber is a hole (room) formed in the housing main body 51. The housing main body 51 is received in the tip of the stay 42. When the housing main body 51 is received in the stay 42, the second connector 43 is received in the stay 42, and attached to the headrest via the stay 42.

Two locking projections 52 are formed on the connector housing 49. The housing main body 51 is interposed between the locking projections 52. The locking projections 52 are projected from a tip of the housing main body 51 near the seat side unit 40. A tapered wall 54 is formed on each locking projection 52. The tapered wall 54 is so formed that as the tapered wall 54 reaches the seat side unit 40, the tapered wall 54 reaches the housing main body 51. Namely, as the tapered wall 54 reaches the seat side unit 40, a projecting amount from the housing main body 51 decreases. When the locking projection 52 is interposed between the pair of arm members 37 and the locking beak 38, the locking projection 52 is engaged with the locking arm 27. The locking projections 52 are allowed to be engaged with the locking arms 27. When the locking projections 52 are engaged with the locking arms 27, the connectors 4, 43 are connected to each other.

When the seat side unit 40 and the headrest side unit 41 are brought to close to each other to insert the second connector 43 into the holder 3, the locking projections 52 are abut on the locking projections 23 of the holder locking arms 21, and deform the arm main body 22 in a direction of separating the locking projections 23 from the housing main body 26 of the first connector 4. The locking projections 23 compose later-described engagement releasing members 55.

Two pressing projections 53 are formed on the connector housing 49. The housing main body 51 is interposed between the pressing projections 53. Each pressing projection 53 is projected from the tip of the housing main body 51 near the seat side unit 40. The pressing projections 53 are disposed further away from the seat side unit 40 than the locking projections 52. The pressing projections 53 and the locking projections 52 are arranged with gaps along the axis of the stay 42. When the second connector 43 is received in the stay 42, the pressing projections 53 and the locking projections 52 are positioned in the notches 44. When the locking arms 27 and the locking projections 52 are engaged with each other, the pressing projections 53 abut on the locking beaks 38 of the locking arms 27.

The second connector 43 is received in the tip of the stay 42. After the locking projections 52, namely, later-described engagement releasing members 55 release the engagements between the holder locking arms 21 and the locking arms 27, the locking projections 52 are engaged with the other ends of the locking arms 27, so that the second connector 43 is connected to the first connector 4. Then, the second connector 43 and the first connector 4 are pushed toward the bottom wall 12 of the holder 3.

The headrest side unit 41 having a structure described above is assembled as described below. First, as shown in FIG. 6, the second connector 43 and the stay 42 are arranged with a gap along the axis of the stay 42. Then, the second connector 43 is received in the stay 42. Thus, the headrest side unit 41 is assembled.

A clip 5 is made of metal. As shown in FIGS. 1 and 2, the clip 5 integrally includes a straight part 29, a wave part 30 arranged parallel to the straight part 29, and an arc part 31 connecting both one ends of the straight part 29 and the wave part 30. The clip 5 is formed in a substantially U-shape. The clip 5 is resiliently deformable in a direction of approaching and separating the straight part 29 and the wave part 30. When the straight part 29 is inserted into the slit 14, the straight notch 20, and the slit 47, the clip 5 relatively positions the receiving member main body 10, the holder 3, and the stay 42, namely, connectors 4, 43.

Then, the straight part 29 is inserted into the straight notch 20 and the slit 47. The receiving member main body 10 is held between the straight part 29 and the wave part 30. Thus, the clip 5 is attached to the receiving member 9, namely, the seat side unit 40 and the headrest side unit 41 connected to each other.

Figure 3:
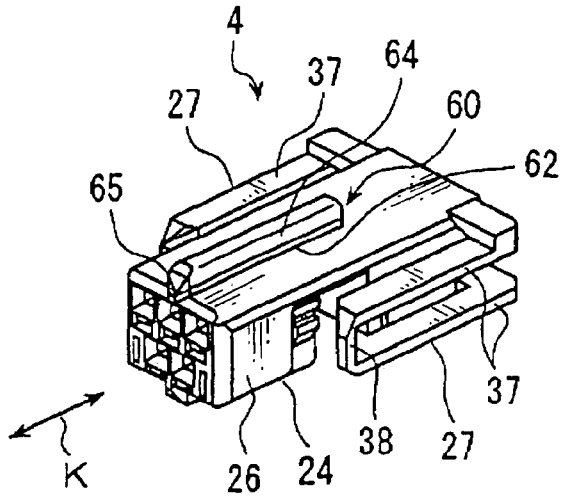
FIG. 3 is a perspective view showing a first connector of the seat side unit shown in FIG. 2.
Figure 4:
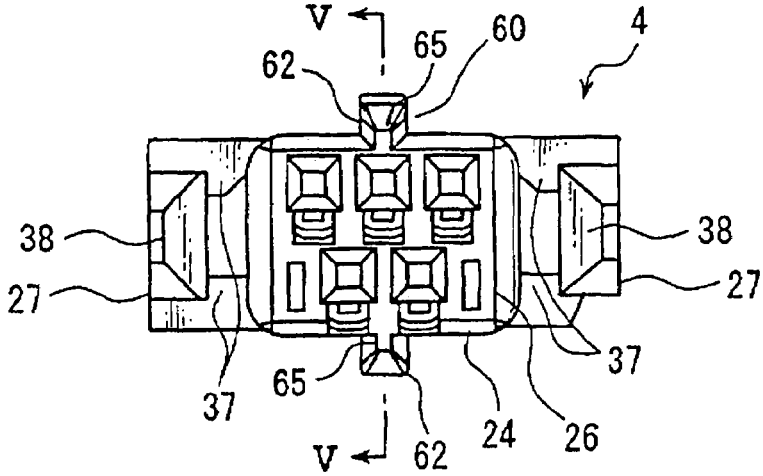
FIG. 4 is a front view showing the first connector shown in FIG. 3.
Figure 5:
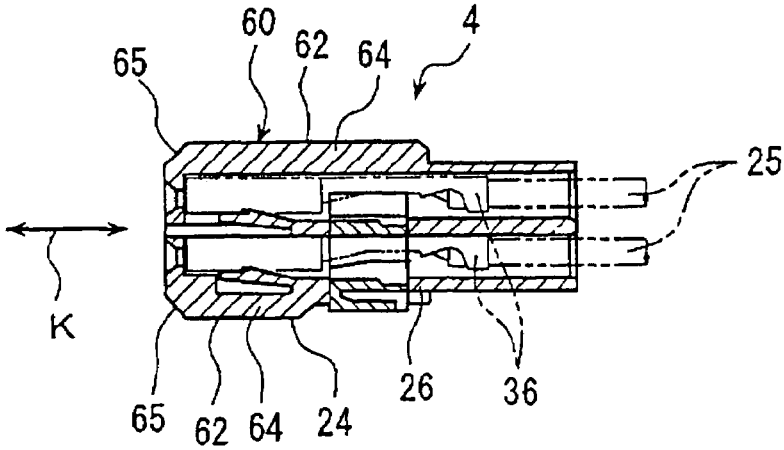
FIG. 5 is a sectional view taken on line V-V in FIG. 4.
Figure 8:
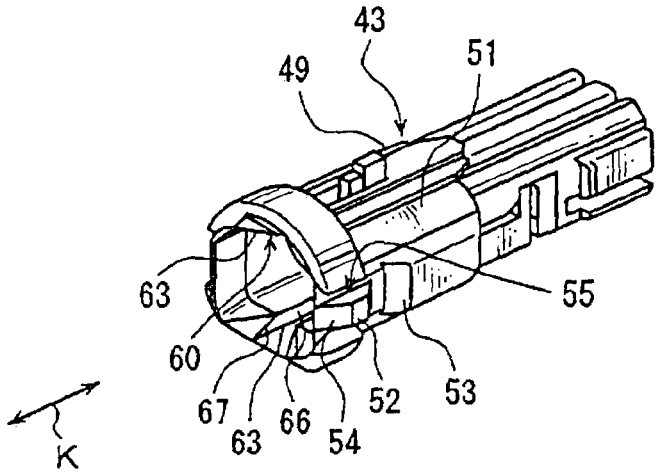
FIG. 8 is a perspective view showing a second connector of the headrest side unit shown in FIG. 6.
Figure 9:
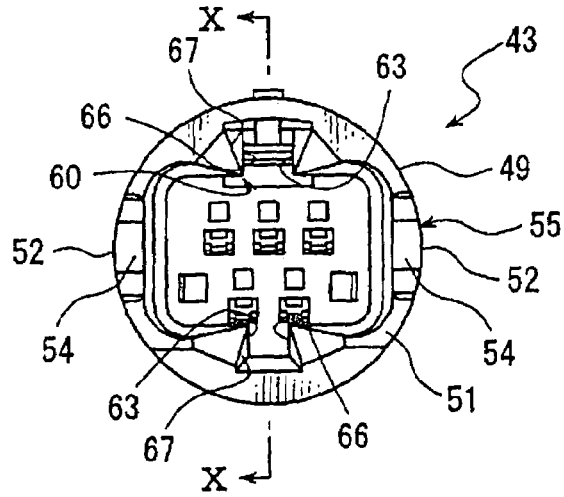
FIG. 9 is a front view showing the second connector shown in FIG. 8.
Figure 10:
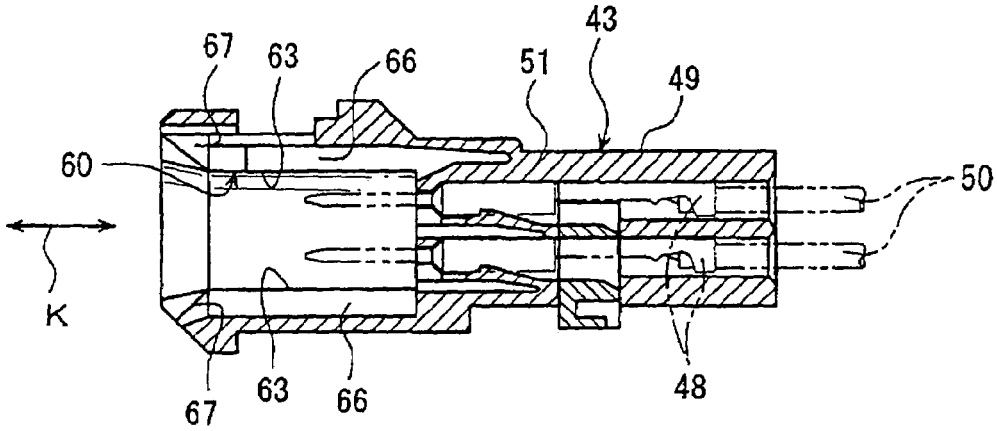
FIG. 10 is a sectional view taken on line X-X in FIG. 9.

The guiding mechanism 60 includes a guiding rib 62 (shown in FIGS. 3 to 5) and a guiding groove 63 (shown in FIGS. 8 to 10). As shown in FIGS. 3 to 5, the guiding rib 62 is projected from an outer wall of the housing main body 26 of the connector housing 24 of the first connector 4. Two guiding ribs are formed on the housing main body 26. Two guiding ribs 62 are formed on outer walls at a rear side holding an axis of the housing main body 26. The guiding rib 62 is extended straight in the connecting direction K of the connectors 4, 43. The guiding rib 62 is extended straight along the connecting direction K from an edge of the housing main body 26 near the second connector 43.

As shown in FIGS. 3 to 5, the guiding rib 62 includes a main body part 64 and a tapered part 65. The main part is so formed that sections thereof are constant. The main body part 64 is formed on the guiding rib 62 except a tip part near the second connector 43. The tapered part 65 is formed on the guiding rib 62 near the second connector 43. The tapered part 65 is so formed that as the tapered part 65 approaches the second connector 43, a width of the guiding rib 62 and a projecting amount from the housing main body 26 decrease. Namely, as approaching the second connector 43, the guiding rib 62 becomes thinner.

As shown in FIGS. 8 to 10, the guiding groove 63 is concaved from an inner wall of the housing main body 51 of the connector housing 49 of the second connector 43. Two guiding grooves 63 are formed on the second connector 43. These two guiding grooves 63 are respectively formed on inner walls facing each other of the housing main body 51. The guiding groove 63 is extended straight in the connecting direction K of the first connectors 4, 43. The guiding groove 63 is extended straight in the connecting direction K from an edge of the housing main body 51 near the first connector 4.

As shown in FIGS. 8 to 10, the guiding groove 63 includes a main body part 66 and a widening tip part 67. A sectional form of the main body part 66 is constant. The main body part 66 is formed on the guiding groove 63 except a tip thereof near the first connector 4. The widening tip part 67 is formed at the tip of the guiding groove 63 near the connector 4. The widening tip part 67 is so formed that as approaching the first connector 4, a width and a depth of the guiding groove 63 increases, namely, as approaching the first connector 4, the guiding groove 63 becomes gradually wider. The guiding rib 62 is inserted into the guiding groove 63 when the connectors 4, 43 are connected to each other. The guiding groove 63 positions the connectors 4, 43 around respective axes thereof.

The connector unit 1 includes the engagement releasing members 55. Each engagement releasing member 55 includes the locking projection 52, and a tapered wall 56 formed on the locking beak 38 of the locking arm 27 of the first connector 4. The tapered wall 56 is formed at a side away from the headrest side unit 41 of the locking beaks 38, and at an edge disposed outside of the connector housing 24 of the first connector 4. The tapered wall 56 approaches the housing main body 26 of the connector housing 24 of the first connector 4 as the tapered wall 56 leaves the headrest side unit 41.

When the locking projections 52 and the locking arms 27 are engaged with each other, the engagement releasing members 55 press outward the locking projections 23 to deform the arm main body 22 in a direction of releasing the engagement between the locking projections 23 and the locking arms 27. Then, when the headrest side unit 41 is brought closer to the seat side unit 40, the locking projections 23 of the holder locking arms 21 run on the tapered walls 56 to fully release the engagements between the holder locking arms 21 and the locking arms 27. Thus, when the locking arms 27 and the locking projections 52 are engaged with each other, and the connectors 4, 43 are connected to each other, the engagement releasing members 55 release the engagements between the holder locking arms 21 and the locking arms 27 to make the connectors 4, 43 movable relative to the holder 3.

Figure 13:
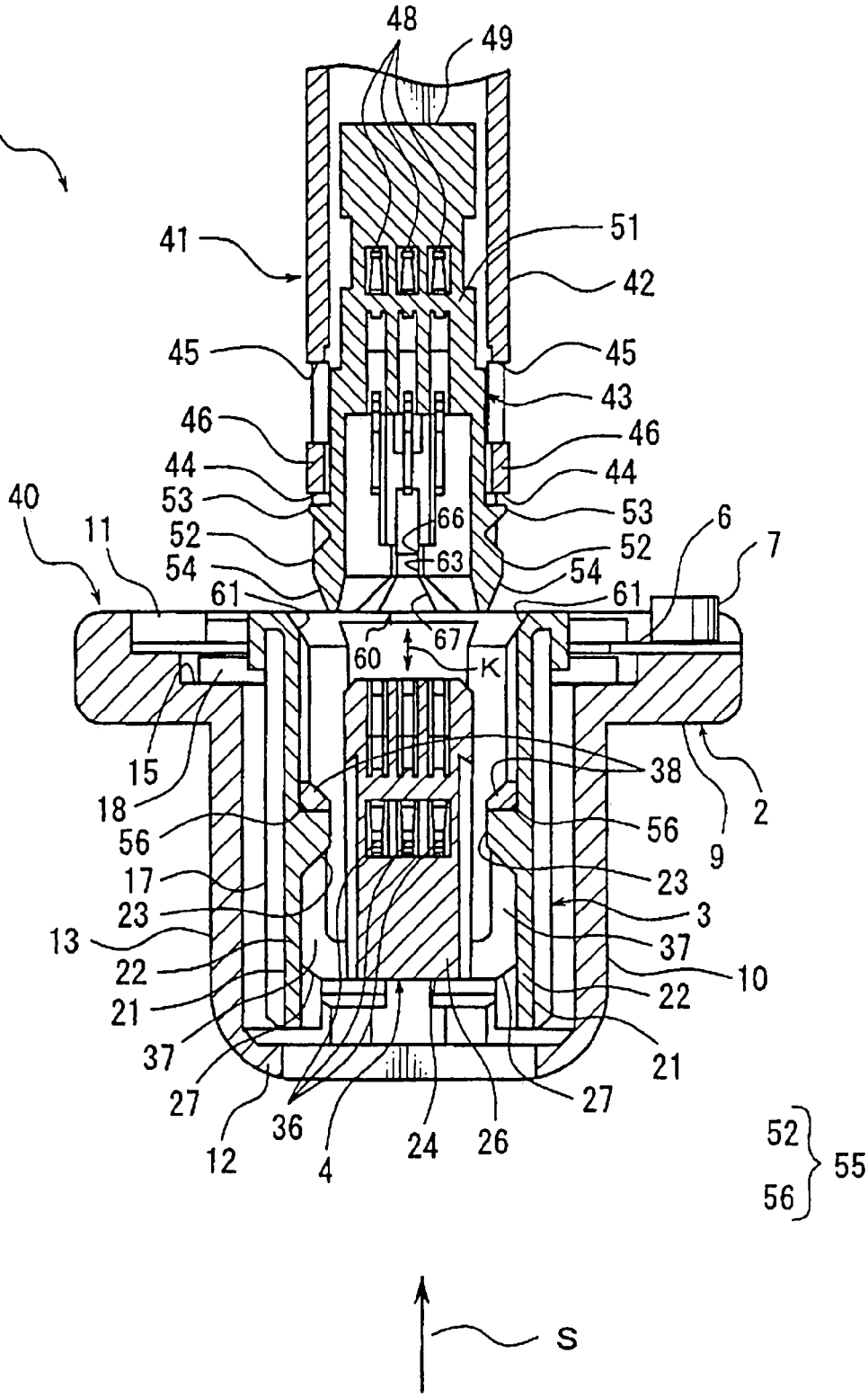
FIG. 13 is a sectional view showing the seat side unit and the headrest side unit approaching each other.

The seat side unit 40 and the headrest side unit 41 having a structure described above are connected to each other as described below. The bracket 2 is attached to the seat, and the stay 42 is attached to the headrest. Then, the seat and the headrest are brought close to each other. First, as shown in FIG. 12, the holder 3 and the second connector 43 are opposed to each other. As shown in FIG. 13, the seat side unit 40 and the headrest side unit 41 are brought close to each other. At this time, the holder locking arms 21 and the locking arms 27 are engaged with each other, and the first connector 4 is held in the holder 3.

Figure 14:
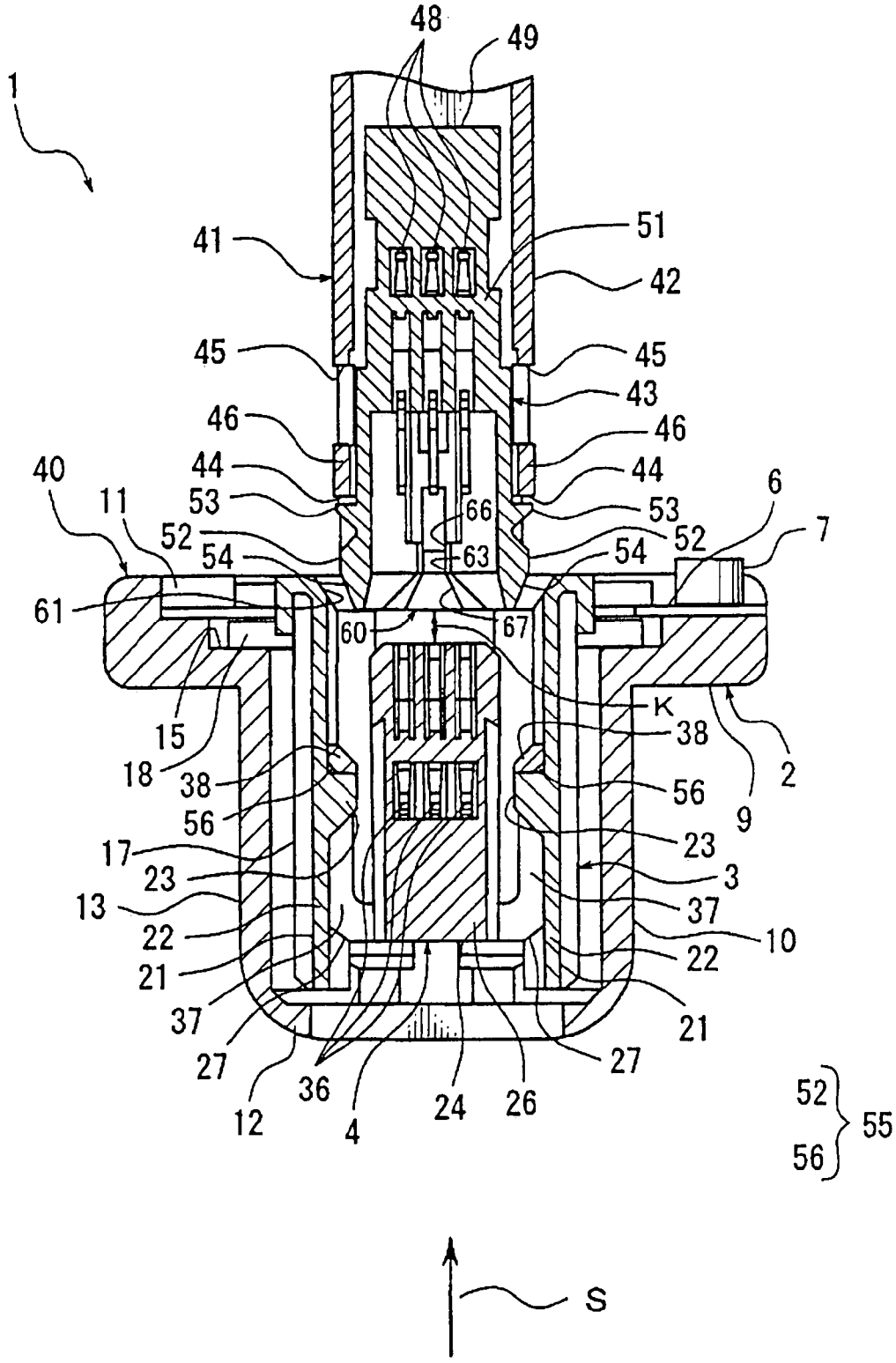
FIG. 14 is a sectional view showing the second connector of the headrest side unit inserted into the holder of the seat side unit shown in FIG. 13.
Figure 15:
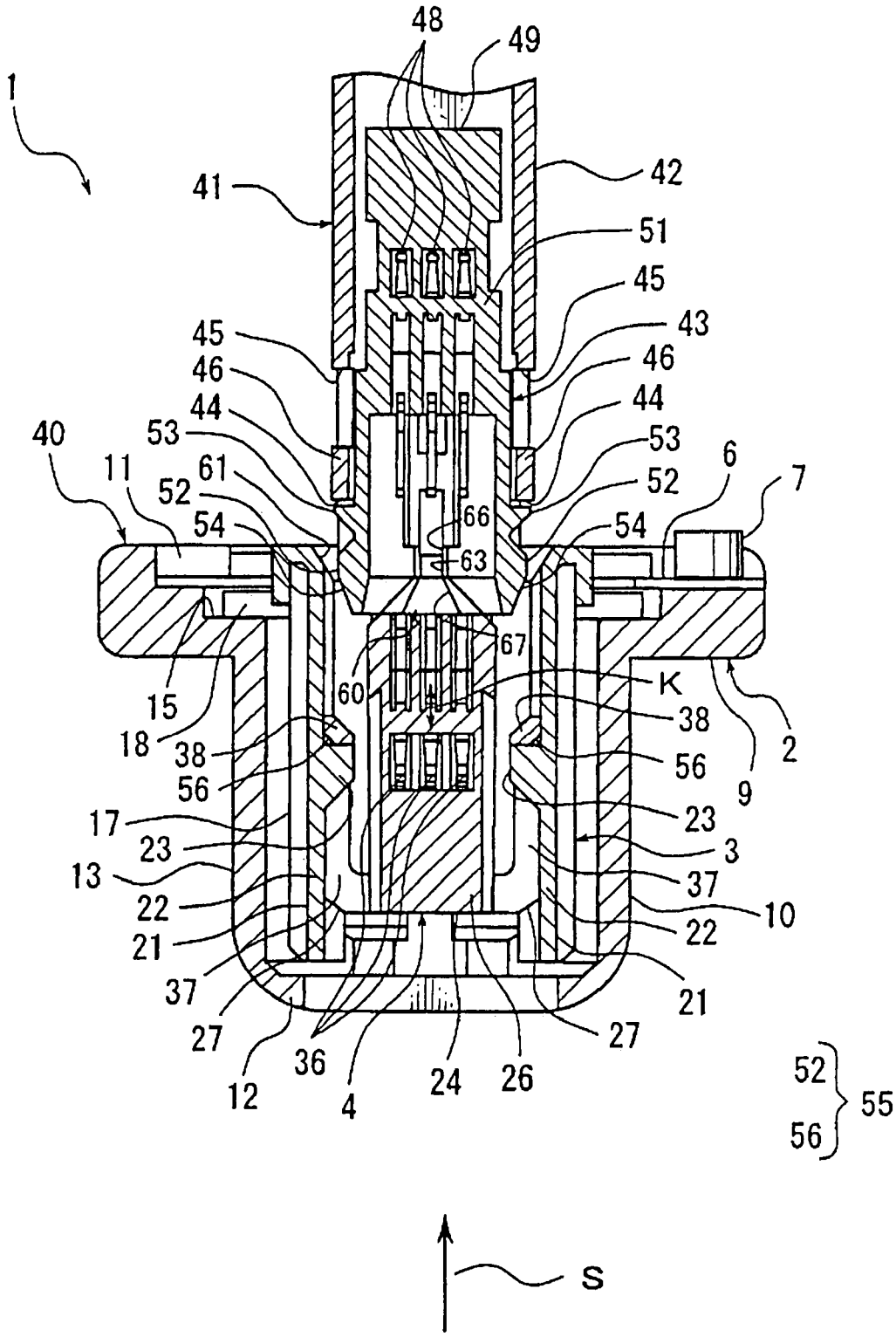
FIG. 15 is a sectional view showing a second connector of the headrest side unit further inserted into a holder of the seat side unit shown in FIG. 14.
Figure 16:
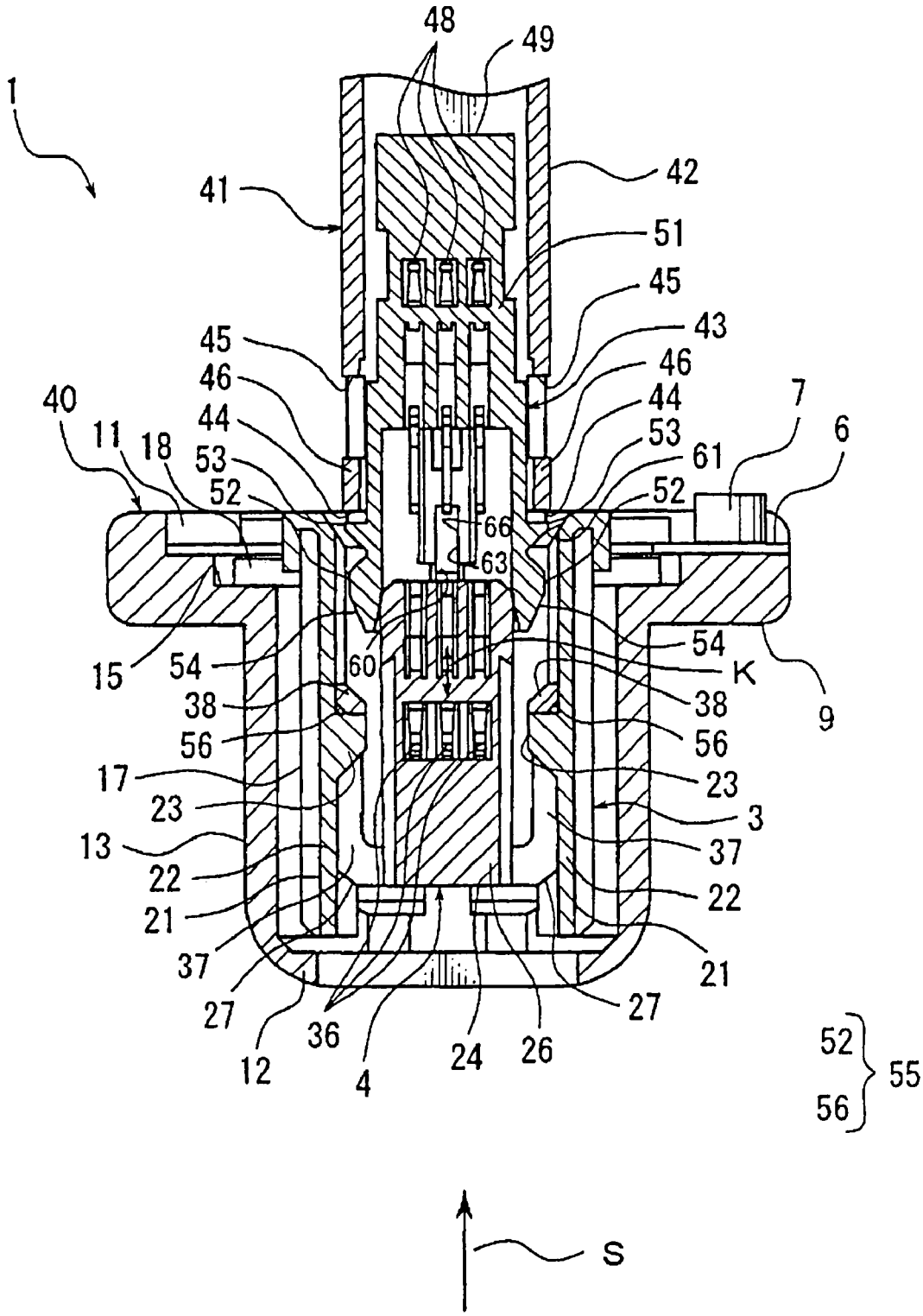
FIG. 16 is a sectional view showing a housing main body of the first connector of the seat side unit inserted into the second connector of the headrest side unit.
Figure 17:
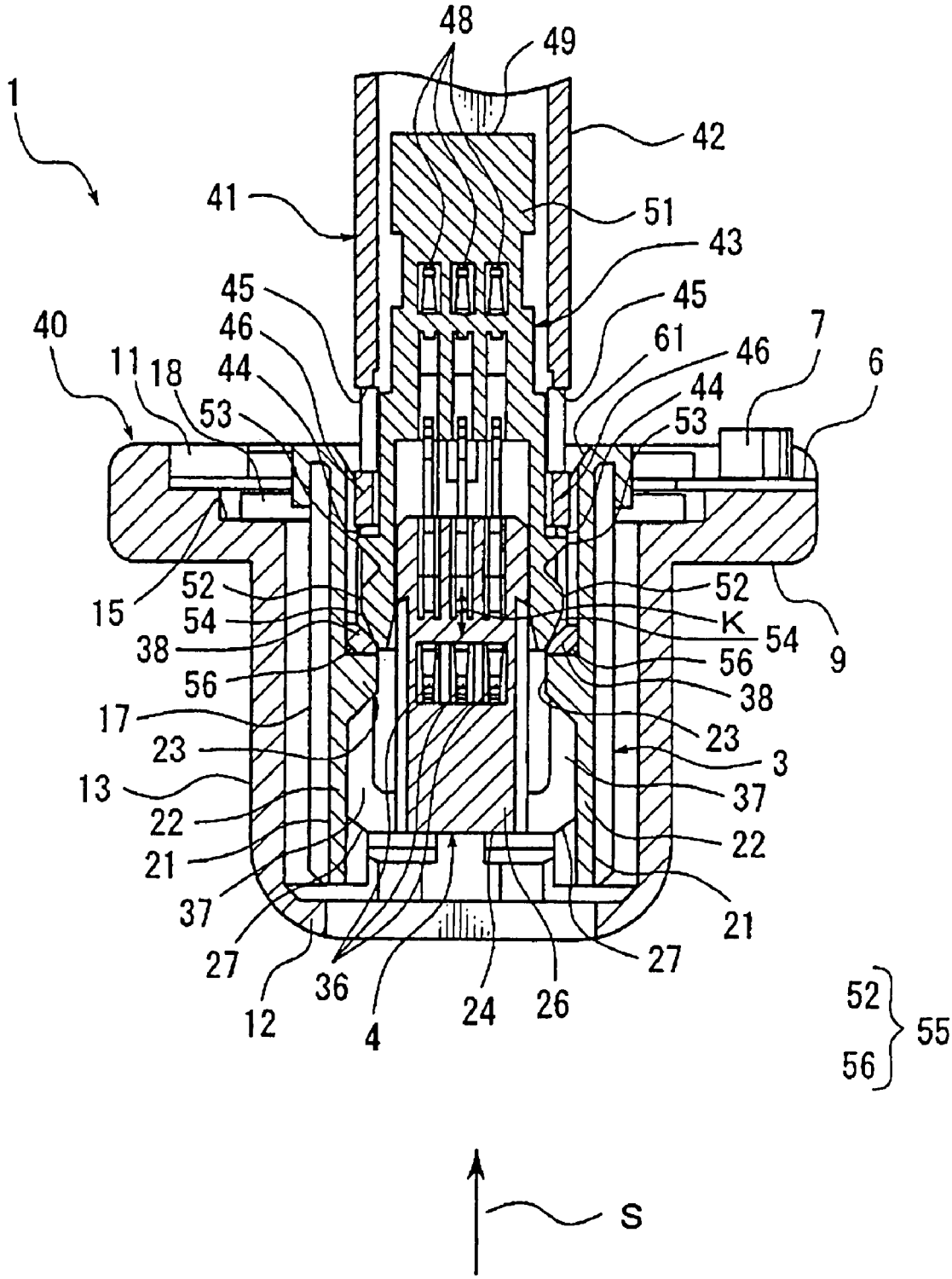
FIG. 17 is a sectional view showing a locking projection of the second connector of the headrest side unit abutting on a locking beak of the first connector of the seat side unit shown in FIG. 16.

Then, as shown in FIG. 14, the second connector 43 guided by the tapered wall 61 is inserted into the holder 3. Then, as shown in FIGS. 15 and 16, the tapered part 65 of the guiding rib 62 is inserted into the widening tip part 67 of the guiding groove 63. Then, if the rotational direction around the common axis of the connectors 4, 43 is different from the predetermined direction, an inner wall of the widening tip part 67 interferes with the outer wall of the tapered part 65, so that the first connector 4 is rotated to the predetermined direction. Thus, the connectors 4, 43 are aligned with each other. Then, as shown in FIG. 16, the housing main body 26 of the connector housing 24 of the first connector 4 is inserted into the connector housing 49 of the second connector 43. Then, as shown in FIG. 17, the locking projections 52 of the second connector 43 contact the locking beaks 38 of the locking arms 27 of the first connector 4. Then, the tapered walls 54 of the locking projections 52 press the locking beaks 38, and the locking arms 27 are deformed in directions that the locking beaks 38 are brought away from the housing main body 26.

Figure 18:
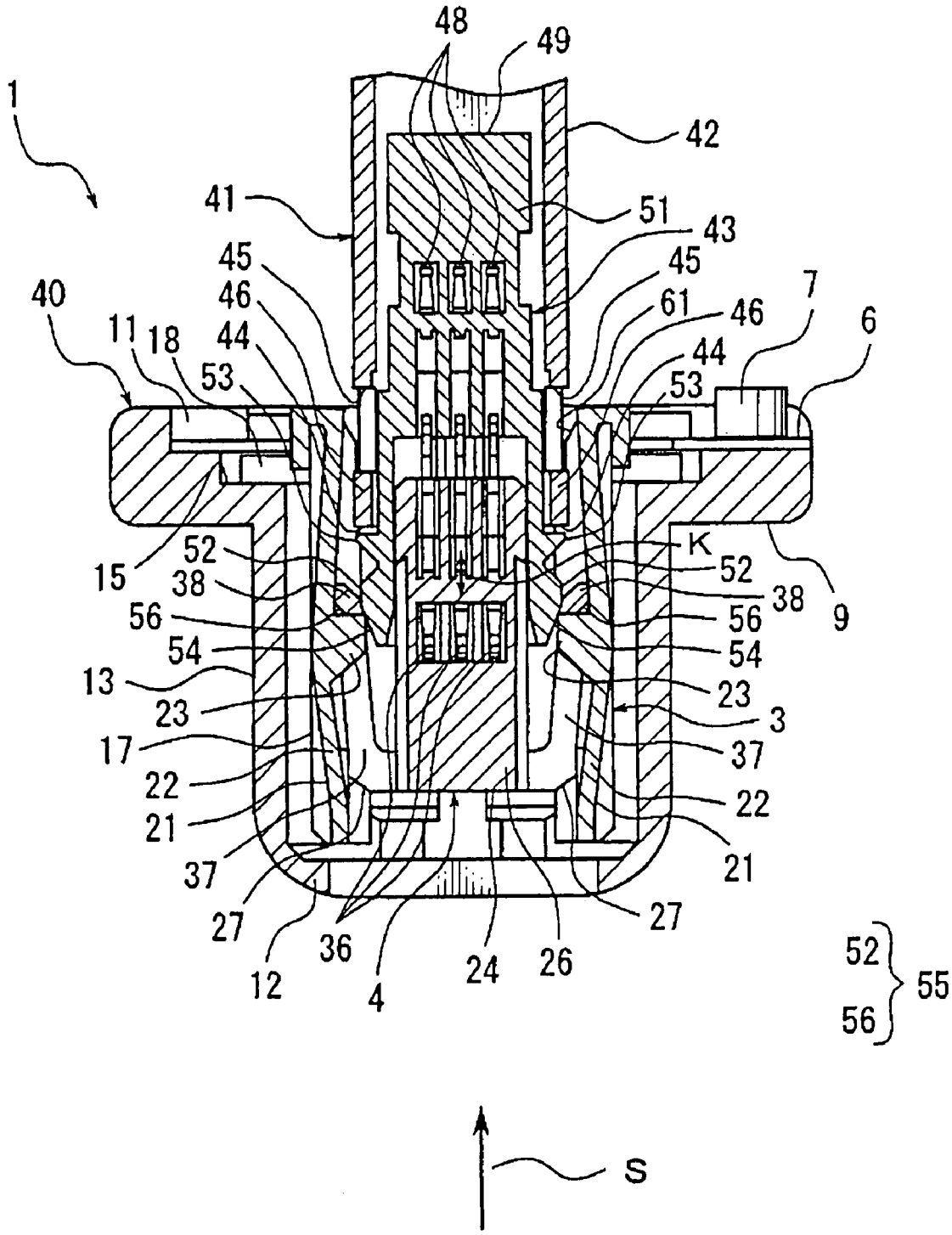
FIG. 18 is a sectional view showing the locking beak of the first connector of the seat side unit running on the locking projection of the second connector of the headrest side unit.
Figure 19:
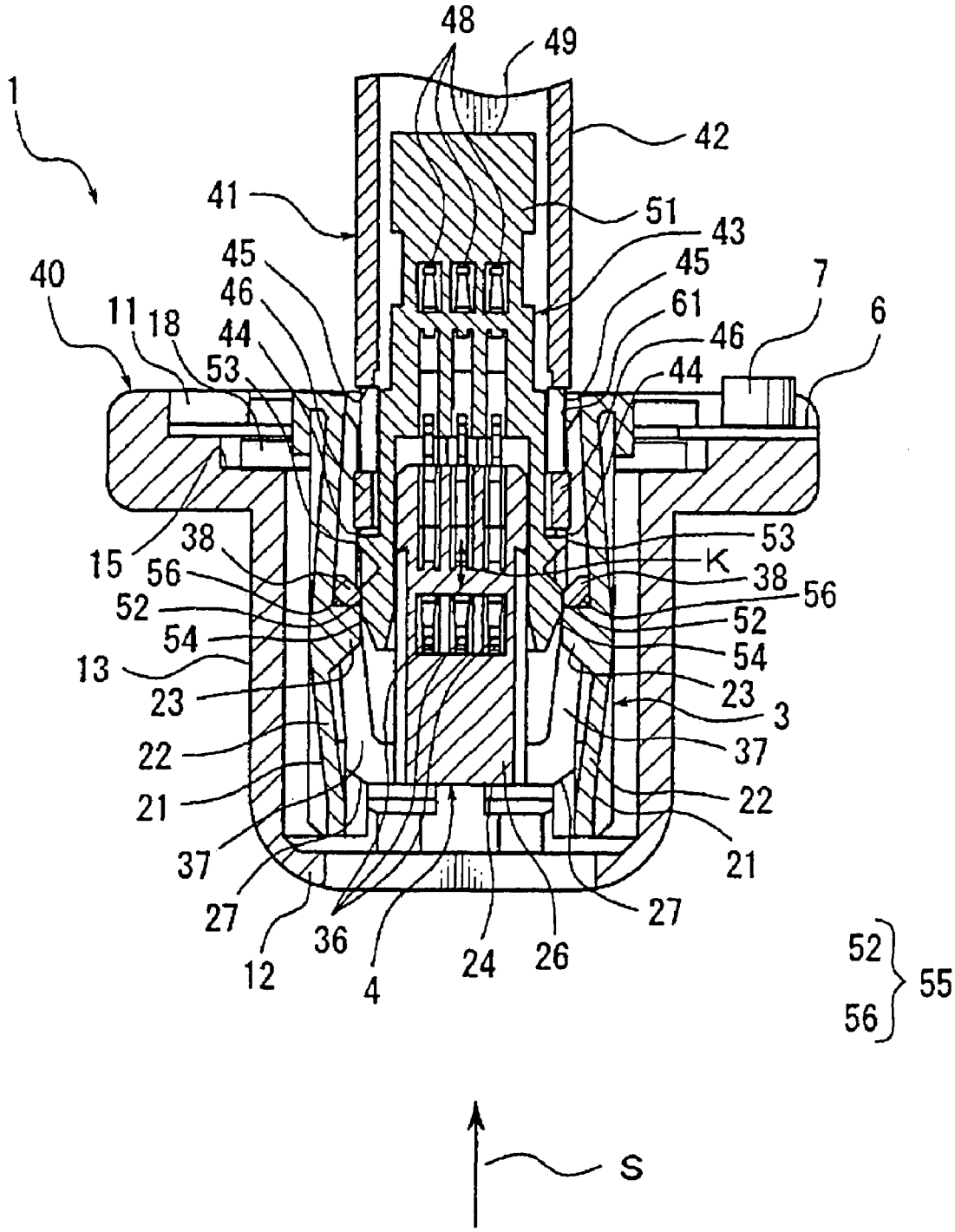
FIG. 19 is a sectional view showing a locking projection of the holder of the seat side unit shown in FIG. 18 running on the locking projection of the second connector of the headrest side unit.

Further, as shown in FIG. 18, when the second connector 43 of the headrest side unit 41 is inserted into the holder 3, the locking projections 23 of the holder locking arms 21 run on the tapered walls 54 of the locking projections 52. Then, as shown in FIGS. 18 to 20, the locking beaks 38 and the locking projection 23 of the holder locking arms 21 run on the locking projections 52 of the second connector 43, so that the holder locking arms 21 are resiliently deformed in directions that the locking projection 23 are brought away from the housing main body 26.

Figure 20:
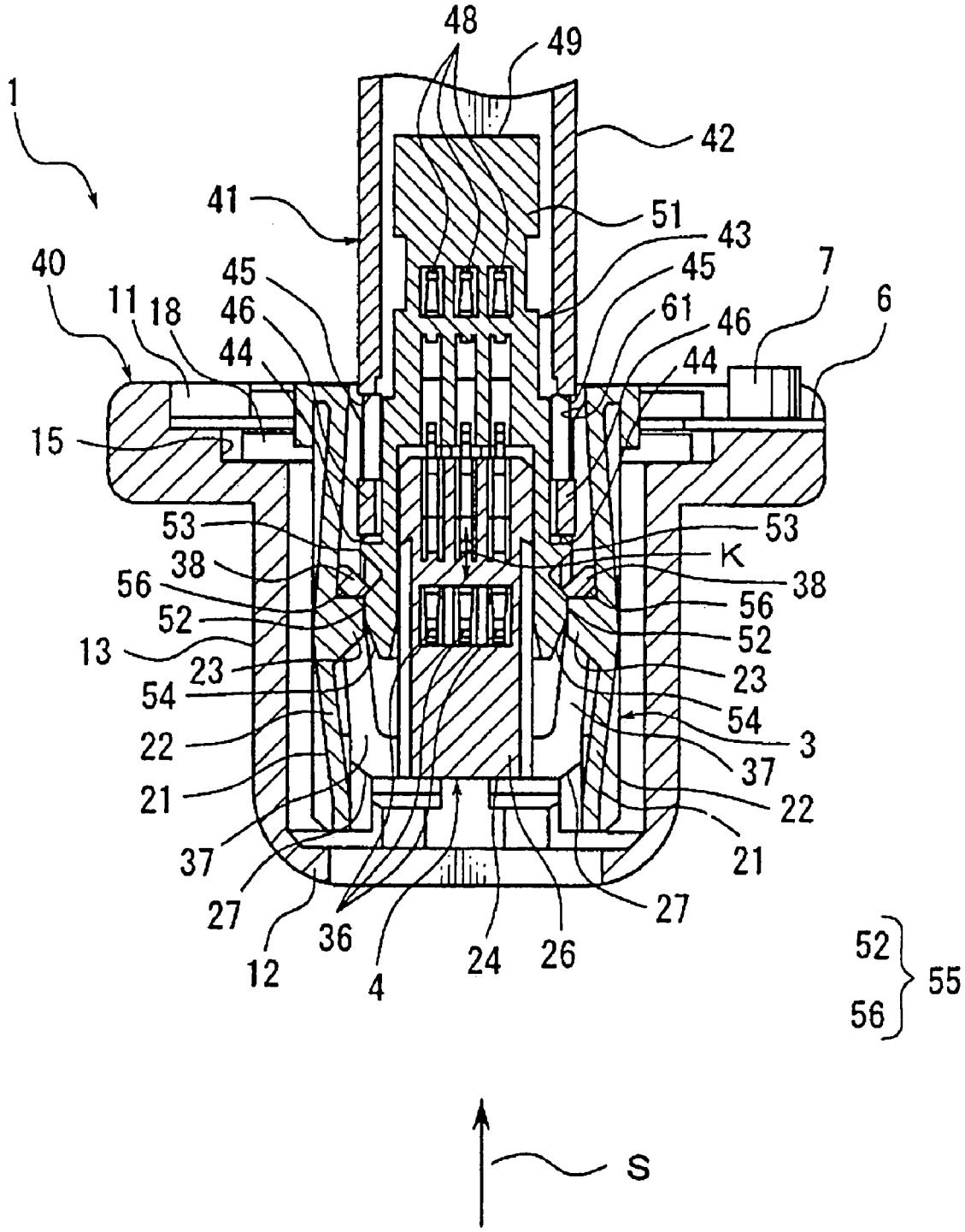
FIG. 20 is a sectional view showing the locking beak of the first connector of the seat side unit shown in FIG. 19 running over the locking projection of the second connector of the headrest side unit.
Figure 21:
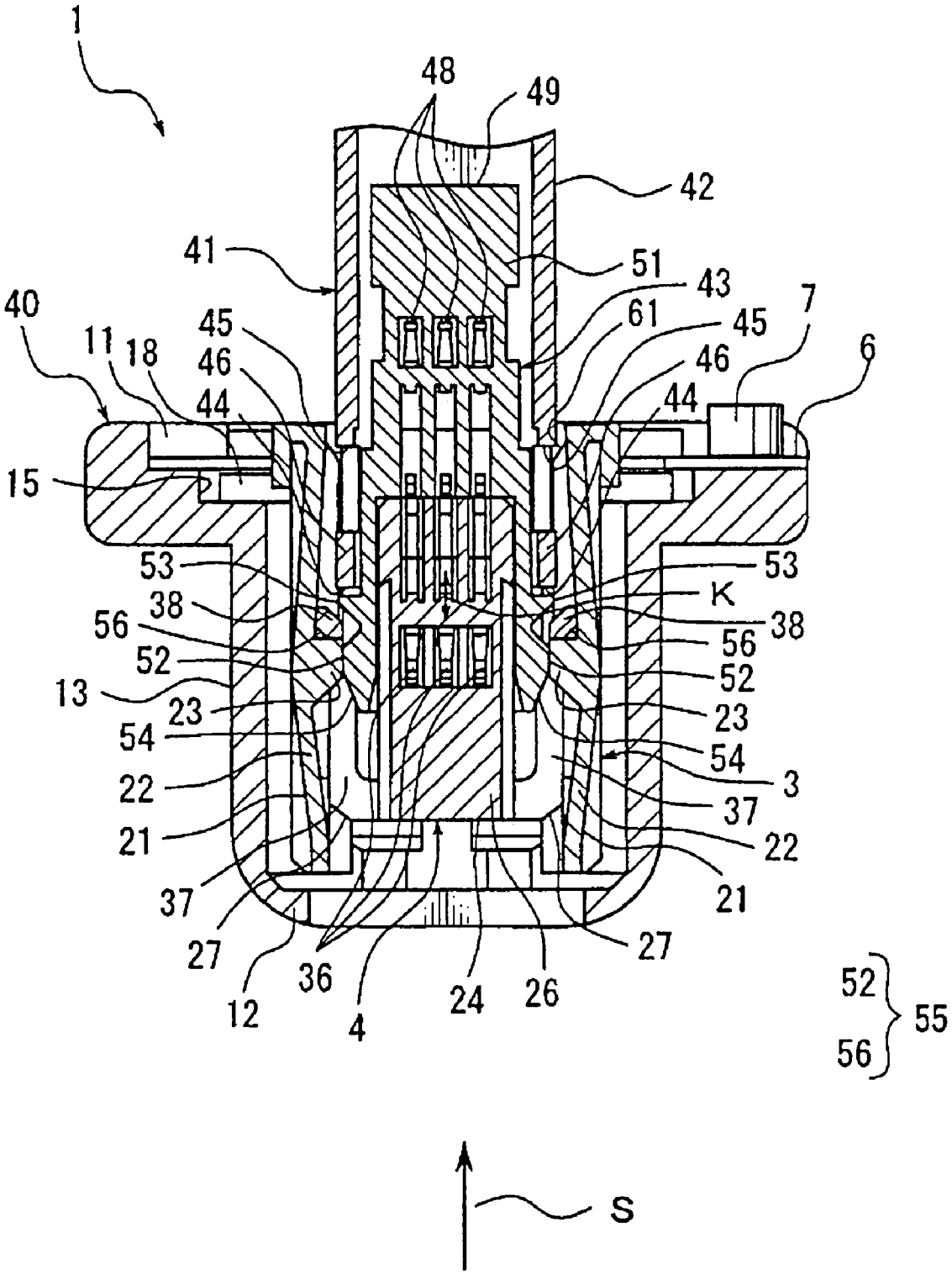
FIG. 21 is a sectional view showing the first connector of the seat side unit and the second connector of the headrest side unit shown in FIG. 20 connected to each other.

Then, as shown in FIG. 20, when the second connector 43 of the headrest side unit 41 is inserted into the holder 3, the locking beaks 38 run over the locking projections 52 of the second connector 43. Then, the locking arms 27 are going to return to neutral positions in directions that the locking beaks 38 are brought close to housing main body 26. Then, as shown in FIG. 21, the locking arms 27 returns to the neutral positions, so that the locking arms 27 and the locking projections 52 are engaged with each other (namely, the connectors 4, 43 are connected to each other). Further, the locking projection 23 of the holder locking arms 21 run on the locking projections 52 of the second connector 43, so that the engagements between the holder locking arms 21 and the locking arms 27 are released.

Figure 22:
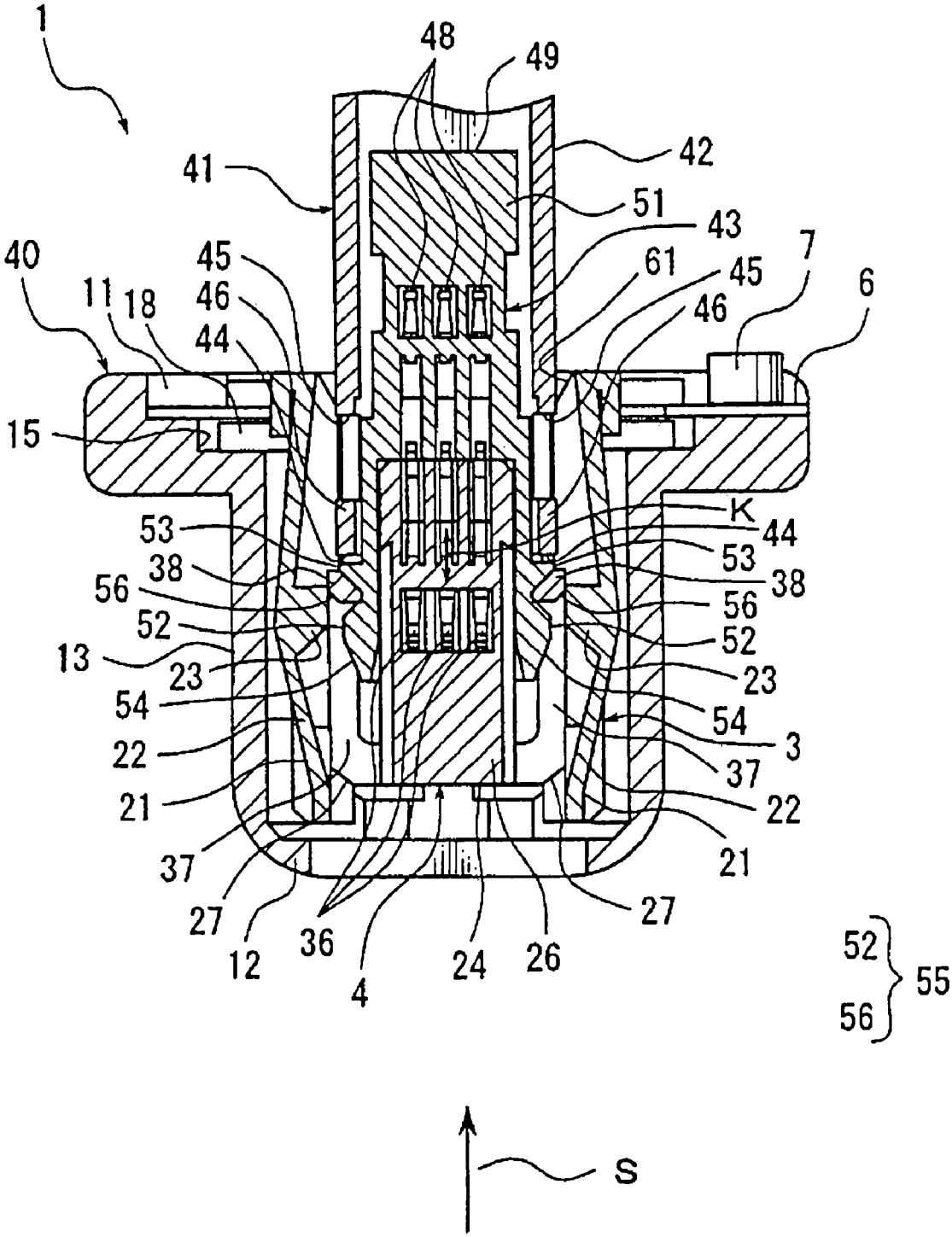
FIG. 22 is a sectional view showing a state that an engagement between a holder locking arm of the holder of the seat side unit shown in FIG. 21 and the locking arm of the first connector is fully released.
Figure 23:
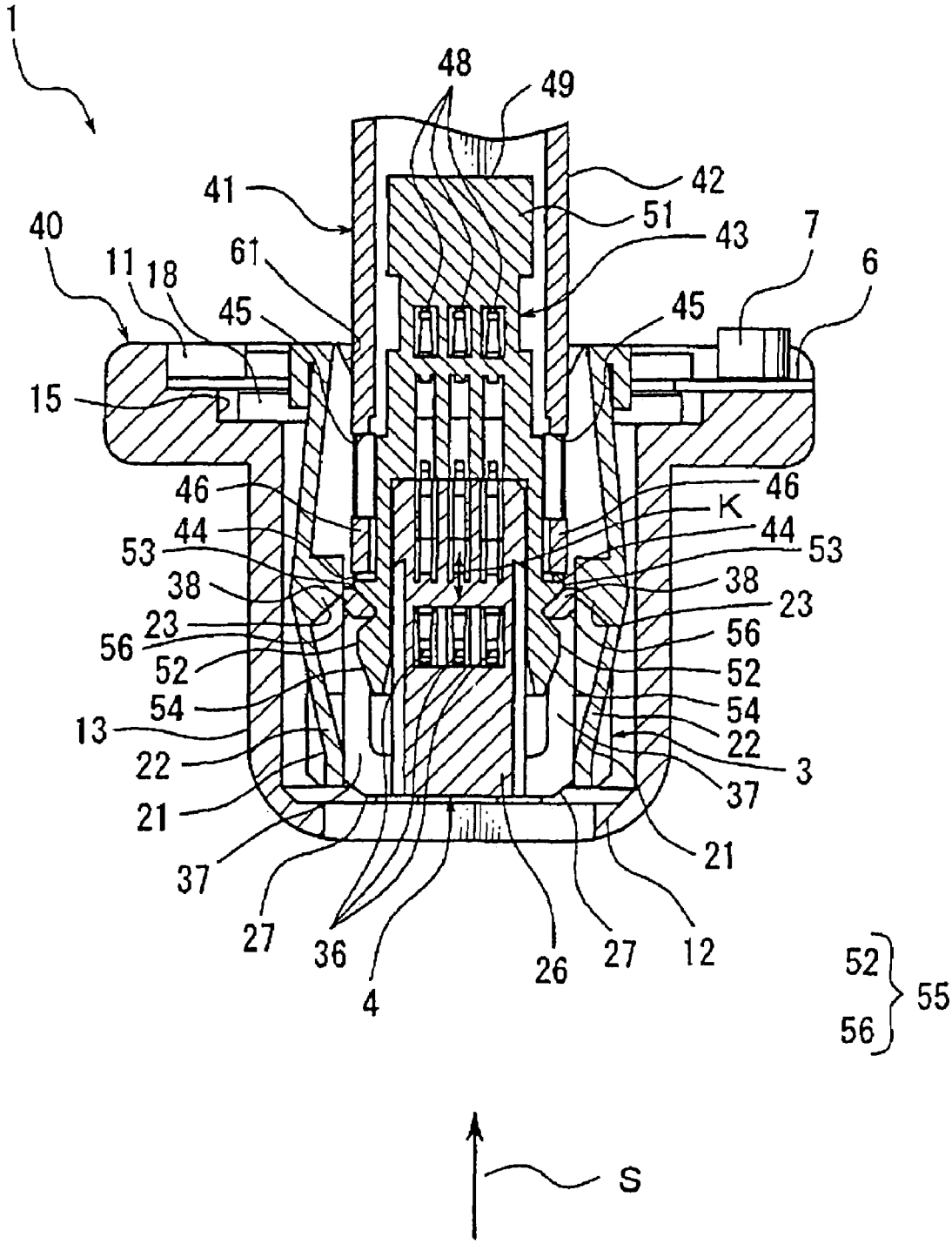
FIG. 23 is a sectional view showing a locking projection of the holder locking arm of the holder of the seat side unit shown in FIG. 22 running on the locking beak of the first connector.

When the second connector 43 of the headrest side unit 41 is further inserted into the holder 3, the pressing projections 53 press the locking beaks 38. Then, as shown in FIG. 22, the locking projections 23 of the holder locking arms 21 slide on the tapered walls 56 formed on the locking beaks 38, so that the locking projections 23 run on the locking beaks 38 of the locking arms 27. Thus, the engagements between the holder locking arms 21 and the locking arms 27 are fully released, and the connectors 4, 43 connected to each other become movable in the holder 3. Then, as shown in FIG. 23, the locking projections 23 of the holder locking arms 21 slide on the locking beaks 38 of the locking arms 27. Then, as shown in FIG. 24, the locking projections 23 of the holder locking arms 21 fully run over the locking beaks 38 of the locking arms 27.

Figure 24:
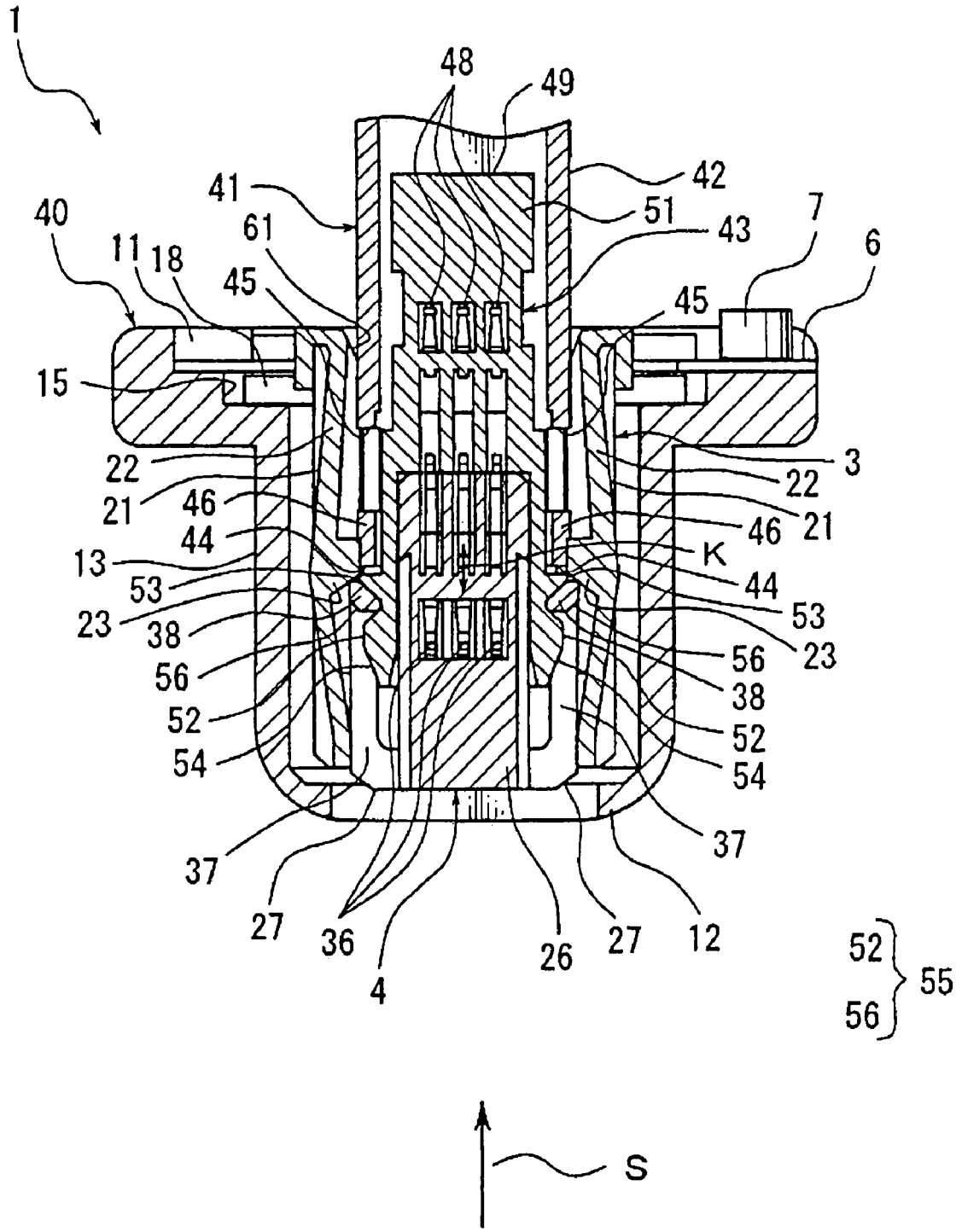
FIG. 24 is a sectional view showing the locking arm of the holder locking arm of the holder of the seat side unit shown in FIG. 23 running on a pressed part of the stay of the headrest side unit.
Figure 25:
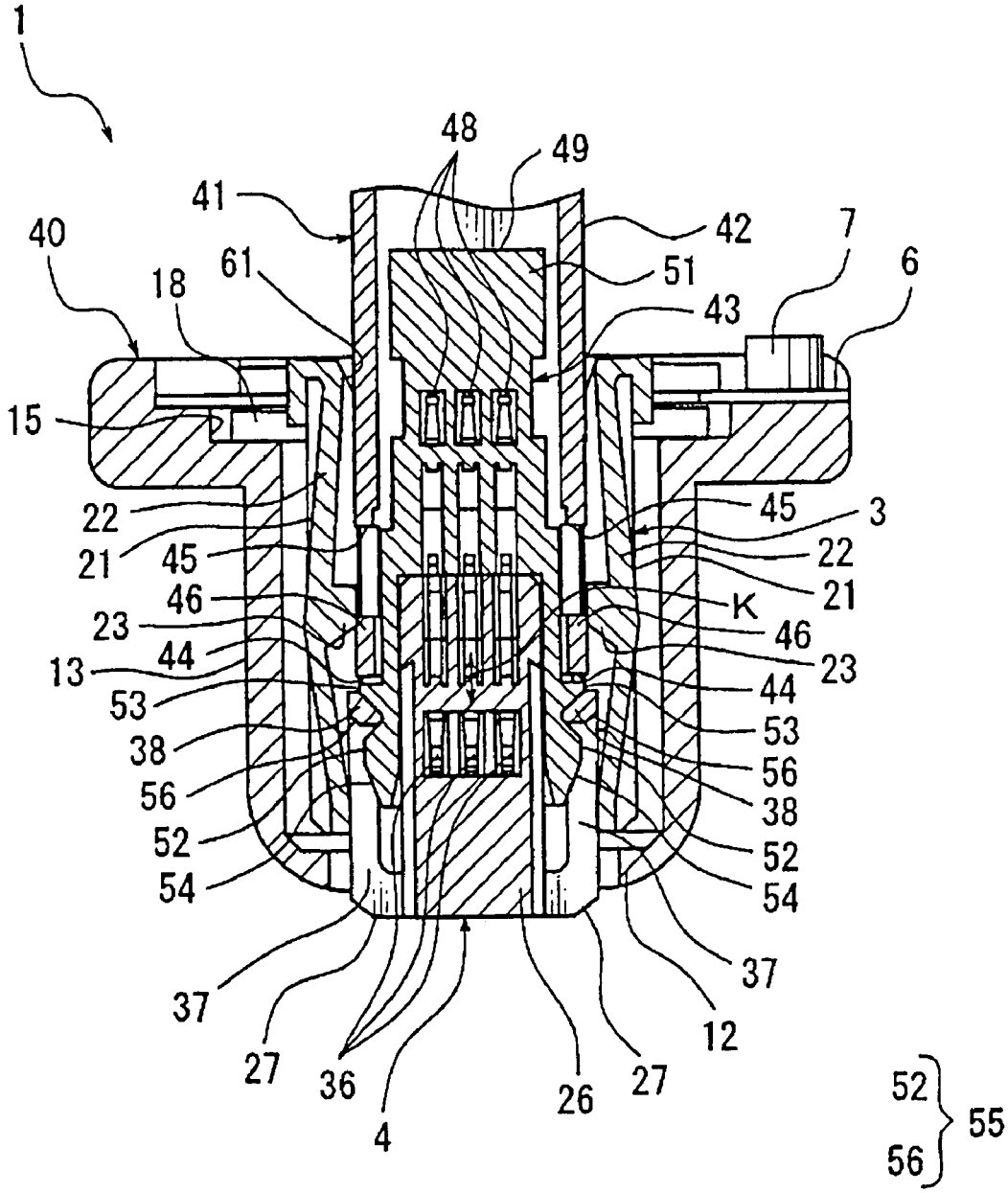
FIG. 25 is a sectional view showing the second connector of the headrest side unit inserted into a further rear side of the holder of the seat side unit shown in FIG. 24.
Figure 26:
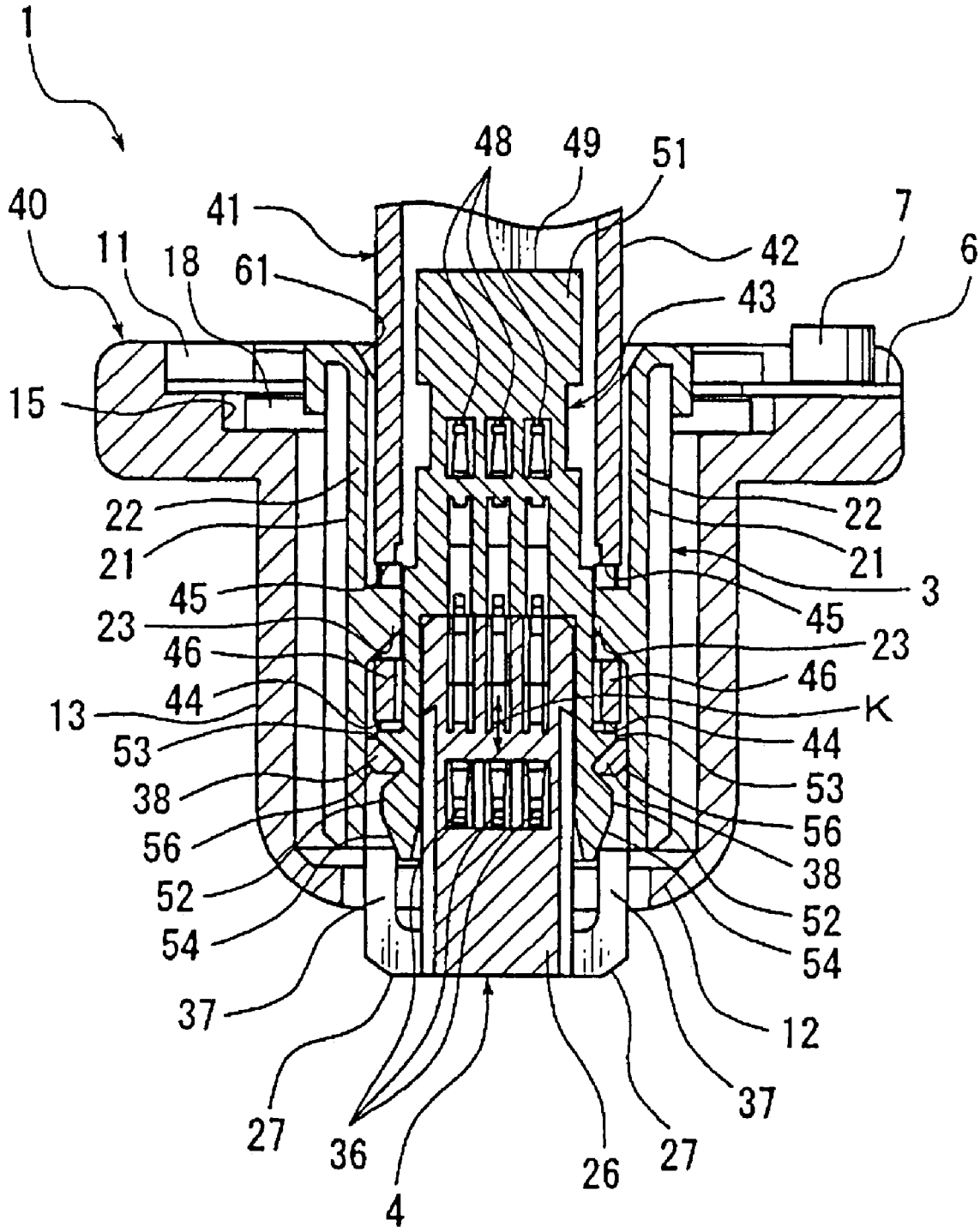
FIG. 26 is a sectional view showing the locking arm of the holder locking arm of the holder of the seat side unit shown in FIG. 25 inserted into an inserted part of the stay of the headrest side unit.

Then, as shown in FIG. 24, the locking projections 23 of the holder locking arms 21 abut on the pressed parts 46 of the stay 42, and the locking projections 23 of the holder locking arms 21 press the pressed parts 46 toward the receiving member main body 10, namely, an inside of the stay 42 owing to the resilient force of the arm main bodies 22. As shown in FIG. 25, when the second connector 43 of the headrest side unit 41 is further inserted into the holder 3, the locking projections 23 of the holder locking arms 21 slide on the pressed parts 46. Then, as shown in FIG. 26, the locking projections 23 of the holder locking arms 21 run over the pressed parts 46 to be inserted into the insertion holes 45. As shown in FIG. 26, when the locking projections 23 are inserted into the insertion holes 45, the arm main bodies 22, namely, the holder locking arms 21 return to the neutral positions without deformation. Further, as shown in FIG. 20, an end of the connector housing 24 of the first connector 4 away from the headrest side unit 41 is projected outward from the holder 3.

Then, the slit 14, the slit 47, and the notches 44 communicate with each other. The straight part 29 of the clip 5 is inserted into the slits 14, 47, and the notches 44, so that the clip 5 is attached to the seat side unit 40 and the headrest side unit 41. The clip 5 positions the receiving member main body 10, the holder 3, and the stay 42 relative to each other to position the connectors 4, 43 connected to each other relative to the holder 3. Thus, in the connector unit 1, the seat side unit 40 and the headrest side unit 41 are connected to each other, namely, the connectors 4, 43 are connected to each other, and the clip 5 supports a load from the stay 42. When the connectors 4, 43 are connected to each other, the terminal fittings 36, 48 are connected to each other. Thus, the connector unit 1 connects the electronic components at a vehicle side to the electronic components mounted on the headrest, and supplies the electric power and the signals to the electronic components mounted on the headrest.

According to this embodiment, because the guiding rib 62 is formed on the first connector 4, and the guiding groove 63 to which the guiding rib 62 is inserted is formed on the second connector 43, when the connectors 4, 43 approach each other, the guiding rib 62 is inserted into the guiding groove 63, so that the connectors 4, 43 are positioned in predetermined positions around the axes thereof. Therefore, even if the connectors 4, 43 are displaced in the rotational direction around the connecting direction K, only by the connectors 4, 43 approaching each other, the connectors 4, 43 are easily connected to each other.

Because the tapered part 65 is formed at the tip of the guiding rib 62, even if the connectors 4, 43 are displaced in the rotational direction around the connecting direction K, by inserting the tapered part 65 into the guiding groove 63, the connectors 4, 43 are positioned in the predetermined positions around the axes thereof.

Because the widening tip part 67 is formed at the tip of the guiding groove 63, even if the connectors 4, 43 are displaced in the rotational direction around the connecting direction K, by inserting the guiding rib 62 into the widening tip part 67, the connectors 4, 43 are positioned in the predetermined positions around the axes thereof.

According to the embodiment described above, the connector unit 1 supplies the desired signal to the electronic components attached to the headrest. However, the present invention is not limited to this. Articles without the headrest and the seat may be used. Articles without vehicle parts can be used for attaching the electronic components to which the signals are supplied.

Further, according to the present invention, one or more than three guiding ribs 62 may be formed on the first connector 4, and one or more than three guiding grooves 63 may be formed on the second connector 43. According to the present invention, one of the tapered part 65 or the widening tip part 67 may not be used.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector unit comprising:

a first connector;

a second connector;

a rotatable holder for receiving the first connector;

a guiding rib projected from an outer wall of the first connector and extended in a connecting direction of the first and second connectors; and a guiding groove concaved from an inner wall of the second connector and extended in the connecting direction, wherein the first connector is inserted into the rotatable holder and rotated to a rotational direction where the guiding rib and the guiding groove are aligned, and when the connectors are connected to each other, the guiding rib is inserted into the guiding groove so as to position the connectors around respective axes thereof.

2. The connector unit as claimed in claim 1, wherein the first connector is attached to a seat, and the second connector is attached to a headrest.

3. The connector unit as claimed in claim 1, further comprising a tapered part formed on a tip of the guiding rib near the second connector, said tapered part causing the guiding rib to be gradually thinner as approaching the second connector.

4. The connector unit as claimed in claim 1, further comprising a widening tip part formed on a tip of the guiding groove near the first connector, said widening tip part causing the guiding groove to be gradually wider as approaching the first connector.

5. The connector unit as claimed in claim 3, further comprising a widening tip part formed on a tip of the guiding groove near the first connector, said widening tip part causing the guiding groove to be gradually wider as approaching the first connector.

6. The connector unit as claimed in claim 5, wherein the widening tip part formed on the tip of the guiding groove interferes with the tapered part formed on the tip of the guiding rib in order to rotate the first connector.

* * * * *